US007845491B2

(12) United States Patent
Polloni et al.

(10) Patent No.: US 7,845,491 B2
(45) Date of Patent: Dec. 7, 2010

(54) RIGID HINGED-LID PACKAGE FOR TOBACCO ARTICLES

(75) Inventors: Roberto Polloni, Modigliana (IT); Marco Brizzi, Zola Predosa (IT)

(73) Assignee: G.D Societa' per Azioni, Bologna (IT)

( * ) Notice: Subject to any disclaimer, the term of this patent is extended or adjusted under 35 U.S.C. 154(b) by 846 days.

(21) Appl. No.: 11/587,520

(22) PCT Filed: Apr. 29, 2005

(86) PCT No.: PCT/EP2005/051979

§ 371 (c)(1),
(2), (4) Date: Jun. 13, 2007

(87) PCT Pub. No.: WO2005/105588

PCT Pub. Date: Nov. 10, 2005

(65) Prior Publication Data

US 2008/0029411 A1 Feb. 7, 2008

(30) Foreign Application Priority Data

Apr. 30, 2004 (IT) ..... B02004A0275
Sep. 23, 2004 (WO) ..... PCT/IB2004/003108

(51) Int. Cl.
*B65D 5/42* (2006.01)
*B65D 85/10* (2006.01)

(52) U.S. Cl. ..... 206/273; 206/271; 206/268; 229/160.1

(58) Field of Classification Search ..... 206/271, 206/273, 831, 242, 268; 40/124.06; 229/116.1, 229/160.1, 87.13, 87.14; D27/183, 186, D27/189, 193
See application file for complete search history.

(56) References Cited

U.S. PATENT DOCUMENTS

| | | | | | |
|---|---|---|---|---|---|
| 2,944,555 | A | * | 7/1960 | Peel et al. | 206/268 |
| 3,028,950 | A | * | 4/1962 | Content | 206/246 |
| 3,874,581 | A | * | 4/1975 | Fox et al. | 206/268 |
| 5,160,024 | A | * | 11/1992 | Evers | 206/268 |
| 5,161,733 | A | * | 11/1992 | Latif | 206/273 |
| 5,236,084 | A | * | 8/1993 | Evers | 206/271 |
| D351,681 | S | * | 10/1994 | Lechere | D27/189 |
| D495,824 | S | * | 9/2004 | Bray et al. | D27/189 |

FOREIGN PATENT DOCUMENTS

| | | |
|---|---|---|
| DE | 38 35 385 | 4/1990 |
| DE | 198 14 255 | 10/1999 |
| WO | 01/28870 | 4/2001 |

* cited by examiner

*Primary Examiner*—J. Gregory Pickett
(74) *Attorney, Agent, or Firm*—Ladas & Parry LLP

(57) ABSTRACT

A rigid package for tobacco articles has a cup-shaped container, which is substantially parallelepiped-shaped and has two major lateral walls, two minor lateral walls, a bottom wall, and an open top end; a cup-shaped lid hinged along a first hinge to rotate between an open position and a closed position respectively opening and closing the open end; and an additional panel hinged to the container along a second hinge to rotate, with respect to the container, between an unfolded position, in which the additional panel is detached from the container, and a folded position, in which the additional panel rests on a major lateral wall of the container and is maintained contacting the major lateral wall of the container by the lid in the closed position.

29 Claims, 26 Drawing Sheets

RIGID HINGED-LID PACKAGE FOR TOBACCO ARTICLES

TECHNICAL FIELD

The present invention relates to a rigid hinged-lid package for tobacco articles.

The present invention may be used to particular advantage in a rigid cigarette packet, to which the following disclosure refers purely by way of example.

BACKGROUND ART

Rigid hinged-lid cigarette packets are currently the most widely marketed, by being easy to make, easy and practical to use, and by providing good mechanical protection of the cigarettes inside.

A rigid hinged-lid cigarette packet normally comprises a cup-shaped container having an open end; and a cup-shaped lid hinged to the container along a hinge to rotate, with respect to the container, between an open position and a closed position respectively opening and closing the open end. When the lid is in the closed position, the packet is parallelepiped-shaped, defined by a lateral surface and two end walls.

The outer surface of the packet is normally printed with the brand, a description of the cigarettes inside the packet, a government health warning, and possibly advertising messages. At times, cigarette manufacturers need to provide customers with a considerable amount of information, which cannot be printed sufficiently clearly on the outer surface of the packet, in view of the relatively small size of the outer surface, and the fact that most of it is occupied by the government health warning. For this reason, it is common practice to provide each cigarette packet with a coupon, which is normally folded accordion-fashion and inserted inside the packet, or is fixed to the outside of the packet by one or more spots of glue.

Rigid cigarette packets with coupons of the type described above are expensive to produce, in that the packing machine must be provided with an additional station for supplying the coupon material. Moreover, a coupon detached from the packet is more awkward to consult, and, above all, is an annoyance to the user if not discarded when unsealing the packet.

WO0128870A1 describes a rigid hinged-lid packet, in which a folding leaflet is glued to a lateral wall of the packet, and is folded accordion-fashion to lie flat on a rear wall of the packet. In use, the user unfolds the leaflet to read the information printed on both sides, and the leaflet normally remains attached to the packet, even though the leaflet may have tear lines by which to tear part or substantially the whole of the leaflet off the packet. The leaflet may contain information of any kind, advertisements, promotion of new products, prize stamps, etc., and is folded out of the packet in such a way that its outer faces show the same contents as the outer faces of the packet, so that it is unnoticeable at a glance.

A rigid cigarette packet with a coupon of the type described in WO0128870A1 solves some of the drawbacks of a rigid cigarette packet with a separate coupon. However, once unfolded when unsealing the packet, the coupon is difficult to fix back onto the packet neatly to avoid annoying the user.

DE19814255A1 discloses a cigarette carton having a main body and a folding lid; the rear face of the main body has additional outward-folding flaps covering the main rear face of the carton.

U.S. Pat. No. 5,236,084A1 discloses a box-like cigarette pack comprising a lid with a tab extending below the bottom of the lid; all or part of the tab may be removed easily by providing a tear line between the removable tab and the rest of the lid. The tab may be printed or embossed with any desired information, and may form a coupon or coupon-like article when removed; until removed, the tab may be somewhat of an impediment to easy removal of the cigarettes or closure of the pack, thereby prompting the consumer to remove the tab as intended.

DE3835385A1 discloses a medication packaging box comprising a closed container having a withdrawal opening on the top side of the container and a closure cap at the withdrawal opening; and an information leaflet fixed at a particular point inside the packaging box; the packaging box is designed to open at the same place at all times, to prevent loss of the information leaflet.

DISCLOSURE OF INVENTION

It is an object of the present invention to provide a rigid hinged-lid package for tobacco articles, which is easier to use than known packages, eliminates the aforementioned drawbacks, and, at the same time, is cheap and easy to produce.

According to the present invention, there is provided a rigid hinged-lid package for tobacco articles, as claimed in the accompanying Claims.

BRIEF DESCRIPTION OF THE DRAWINGS

A number of non-limiting embodiments of the present invention will be described by way of example with reference to the accompanying drawings, in which:

FIGS. 32 and 31 show plan views of a blank by which to produce the rigid cigarette packet in FIGS. 13-29;

BEST MODE FOR CARRYING OUT THE INVENTION

Figure 1:
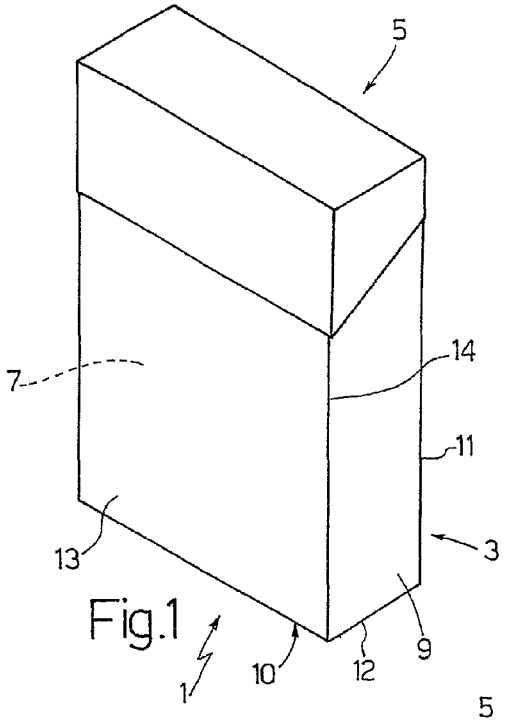
FIG. 1 shows a front view in perspective of a rigid cigarette packet in accordance with the present invention and in a closed configuration.
Figure 4:
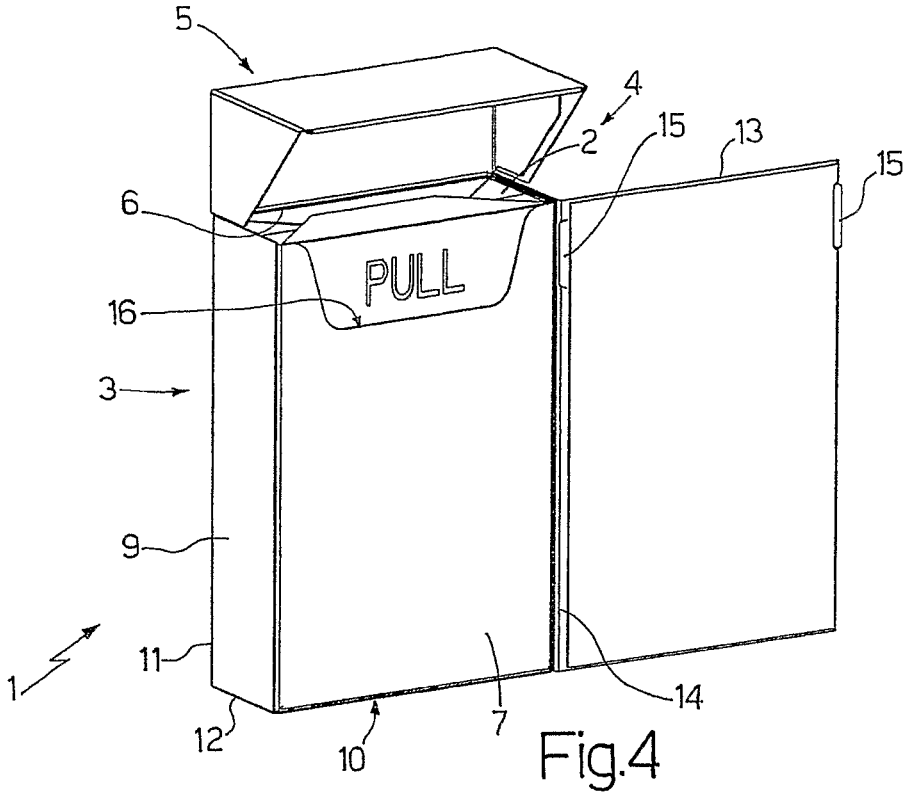
FIG. 4 shows a front view in perspective of the FIG. 1 rigid cigarette packet in an open configuration.

Number 1 in FIG. 1 indicates as a whole a rigid cigarette packet containing an orderly, parallelepiped-shaped group 2 of cigarettes (FIGS. 4 and 5) wrapped in a sheet of foil wrapping material having a tear-off top end frequently marked "PULL".

Packet 1 comprises a cup-shaped container 3 having an open top end 4; and a cup-shaped lid 5 hinged along a hinge 6 to rotate, with respect to container 3, between an open position (FIGS. 3-5) and a closed position (FIGS. 1 and 2) respectively opening and closing open end 4.

Container 3 is parallelepiped-shaped, and has two major lateral walls 7 and 8, two minor lateral walls 9, and a bottom wall 10. As stated, container 3 is open at the top at open top end 4. More specifically, major lateral wall 7 defines a front wall 7 of container 3, and major lateral wall 8 defines a rear wall 8 of container 3.

Four longitudinal edges 11 are defined between minor lateral walls 9 and major lateral walls 7 and 8, and four transverse edges 12 are defined between bottom wall 10 and lateral walls 7, 8 and 9. As shown in the accompanying drawings, longitudinal edges 11 and transverse edges 12 are sharp, square edges.

Packet 1 also comprises an additional panel 13 hinged to container 3 along a hinge 14 to rotate, with respect to container 3, between an unfolded position (FIGS. 4 and 5), in which additional panel 13 is detached from container 3, and a folded position (FIGS. 1-3), in which additional panel 13 rests on major lateral wall 7 or front wall 7 of container 3. More specifically, in the folded position, additional panel 13 is maintained contacting major lateral wall 7 of container 3 by lid 5 in the closed position; for which purpose, additional panel 13 is substantially the same size as major lateral wall 7 or front wall 7 of container 3.

Figure 2:
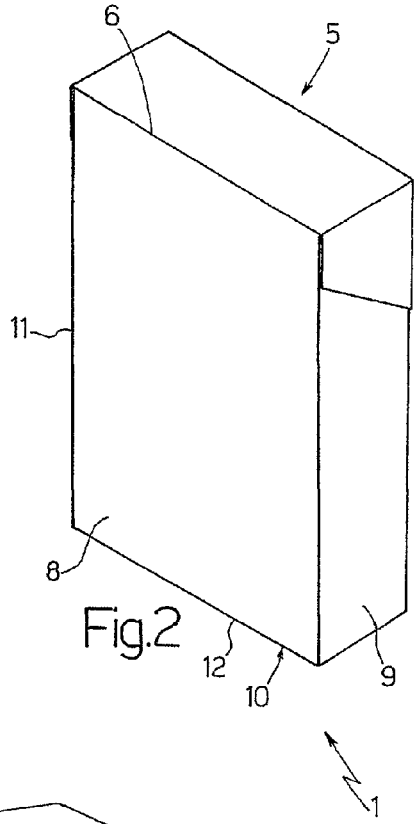
FIG. 2 shows a rear view in perspective of the FIG. 1 rigid cigarette packet in a closed configuration.
Figure 3:
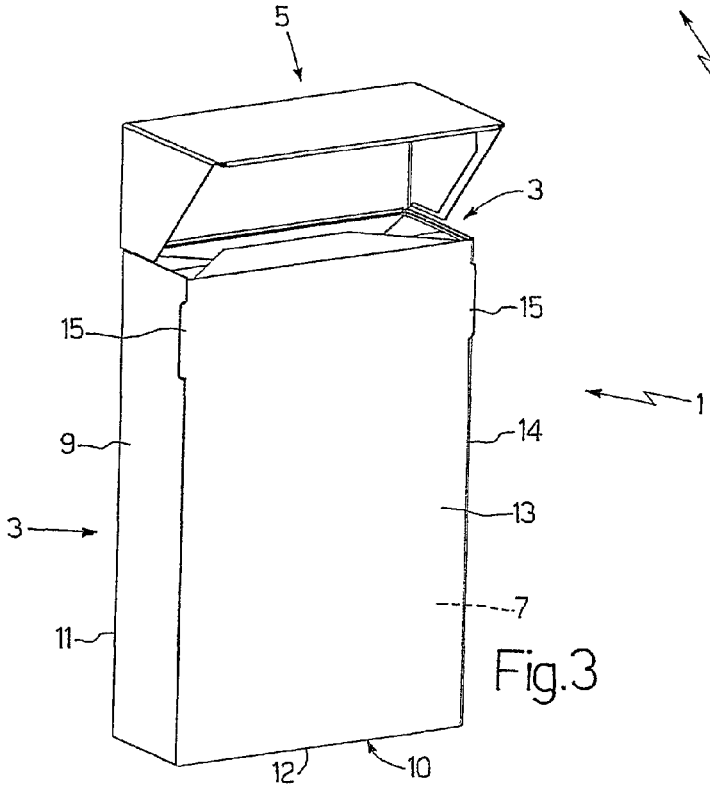
FIG. 3 shows a front view in perspective of the FIG. 1 rigid cigarette packet in a partly-open configuration.

As shown clearly in FIG. 2, lid 5 is hinged to container 3 along hinge 6, which is located on major lateral wall 8 or rear wall 8 of container 3. More specifically, hinge 6 of lid 5 is parallel to transverse edges 12 of container 3, and located at a top perimeter line of major lateral wall 8 or rear wall 8 of container 3.

Hinge 14 of additional panel 13 is parallel to longitudinal edges 11 and coincident with one of the longitudinal edges 11 extending along major lateral wall 7 or front wall 7 of container 3.

In the FIG. 1-5 embodiment, additional panel 13 comprises two projections 15, which project laterally from additional panel 13, engage respective inner surfaces of lid 5 when lid 5 is in the closed position, and provide for keeping lid 5 in the closed position with a certain amount of force, to prevent lid 5 from opening inadvertently.

In an alternative embodiment not shown, projections 15 are only provided on major lateral wall 7 or front wall 7 of container 3, or are provided on both major lateral wall 7 or front wall 7 of container 3, and additional panel 13.

To facilitate withdrawal of the cigarettes from open top end 4 of container 3, a top portion of major lateral wall 7 or front wall 7 of container 3 has a recess 16.

Figure 5:
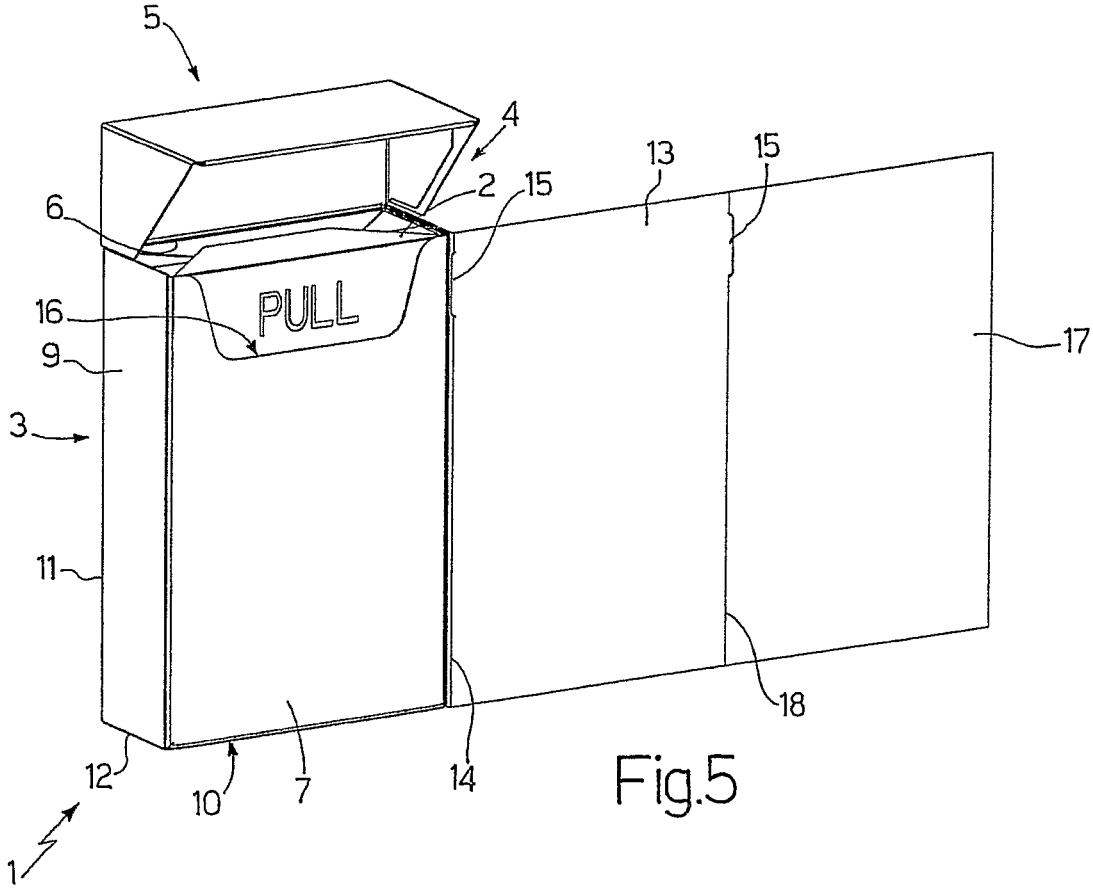
FIG. 5 shows a front view in perspective of the FIG. 1 rigid cigarette packet in a further open configuration.

As shown in FIG. 5, a further panel 17 is preferably hinged to additional panel 13 along a hinge 18 parallel to and opposite hinge 14 of additional panel 13. A number of panels 17 may be provided, hinged to one another to unfold accordion-fashion.

In one possible embodiment, hinge 14 of panel 13 and/or hinge 18 of panel 17 are each/is defined by a tear line enabling easy detachment by the user of panel 17, or of panel 13 together with panel 17, from container 3.

Figure 6:
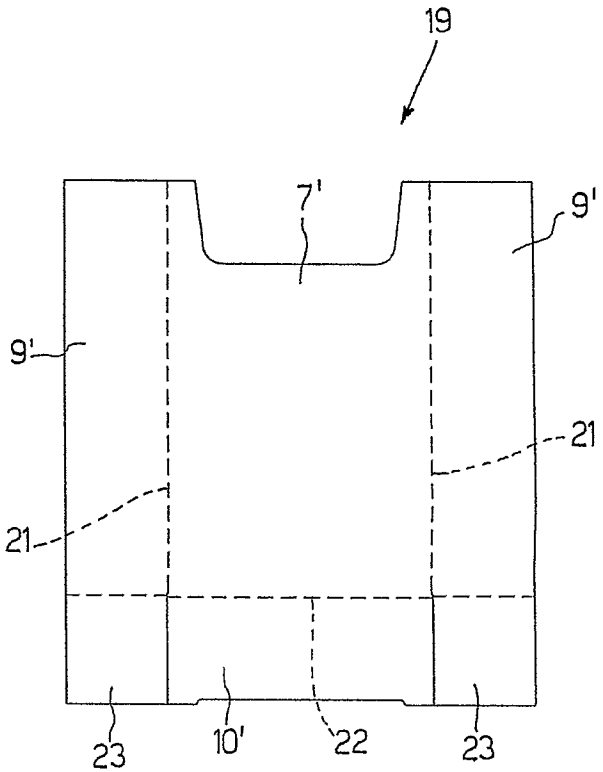
FIGS. 6 and 7 show plan views of two blanks by which to produce the rigid cigarette packet in FIGS. 1 to 5.
Figure 7:
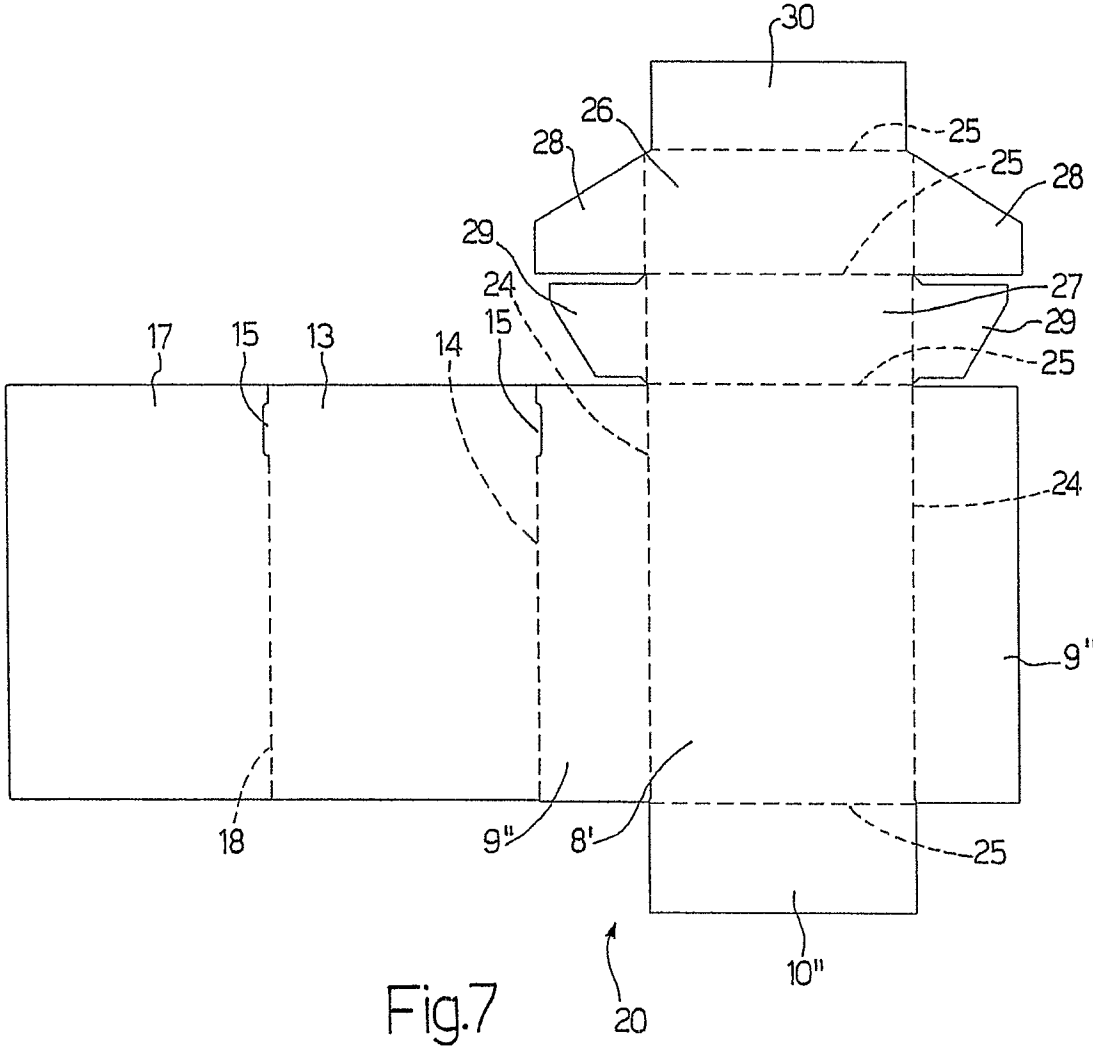

As shown in FIGS. 6 and 7, container 3 in FIGS. 1 to 5 is formed from two flat blanks 19 and 20, the component parts of which are indicated where possible using the same reference numbers, with superscripts, as for the corresponding parts of container 3.

Blank 19 comprises two longitudinal fold lines 21; and a transverse fold line 22 defining, between the two longitudinal fold lines 21, a panel 7' defining major lateral wall 7 or front wall 7 of container 3, and a second panel 10' defining part of bottom wall 10 of container 3. Panel 7' has two wings 9', which define respective parts of minor lateral walls 9 of container 3, are located on opposite sides of panel 7', and are separated from panel 7' by longitudinal fold lines 21; and each wing 9' has a respective tab 23 separated from wing 9' by transverse fold line 22.

Blank 20 comprises two longitudinal fold lines 24; and a number of transverse fold lines 25 defining, between the two longitudinal fold lines 24, a panel 26 defining a front wall of lid 5, a panel 27 defining a top wall of lid 5, a panel 8' defining major lateral wall 8 or rear wall 8 of container 3, and a panel 10" defining part of bottom wall 10 of container 3. Panel 8' has two wings 9", which define respective parts of minor lateral walls 9 of container 3, are located on opposite sides of panel 8', and are separated from panel 8' by longitudinal fold lines 24. Additional panel 13 is connected to one of wings 9" of panel 8' along hinge line 14 coincident with one of longitudinal fold lines 24.

Preferably, panel 26 comprises two wings 28, which define the lateral walls of lid 5, are located on opposite sides of panel 26, and are separated from panel 26 by longitudinal fold lines 24; and panel 27 comprises two wings 29 located on opposite sides of panel 27 and separated from panel 27 by longitudinal fold lines 24. Panel 26 also comprises a reinforcing flap 30 which is folded onto panel 26.

Figure 8:
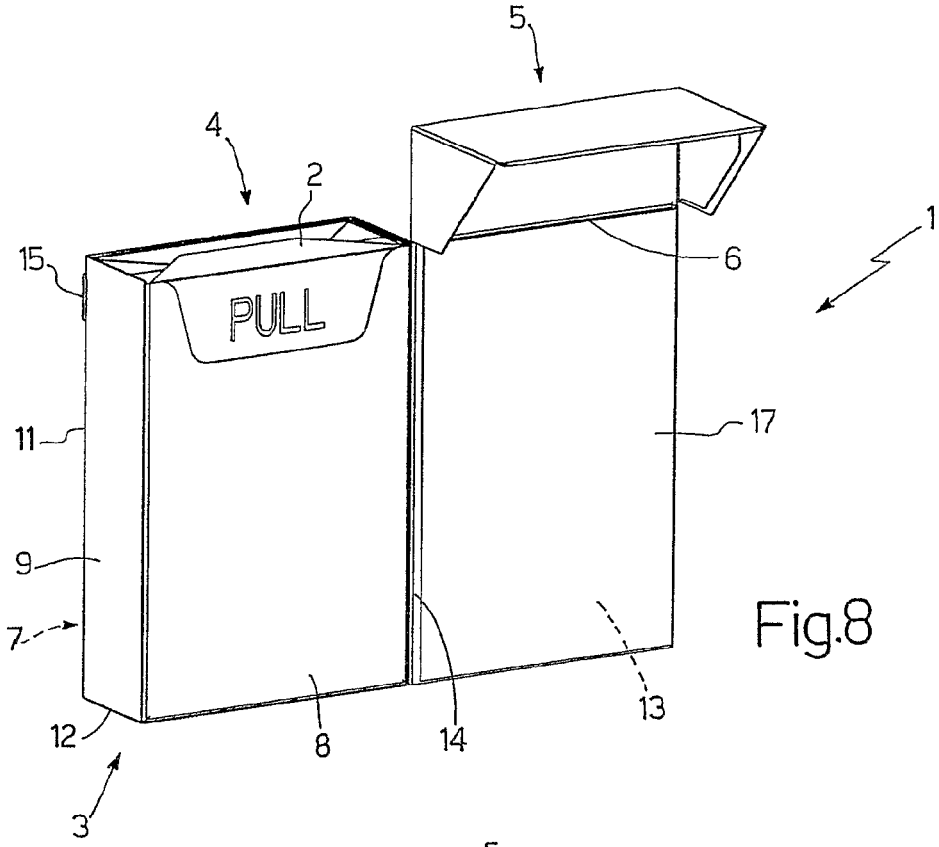
FIG. 8 shows a front view in perspective of a rigid cigarette packet in accordance with the present invention and in an open configuration.
Figure 9:
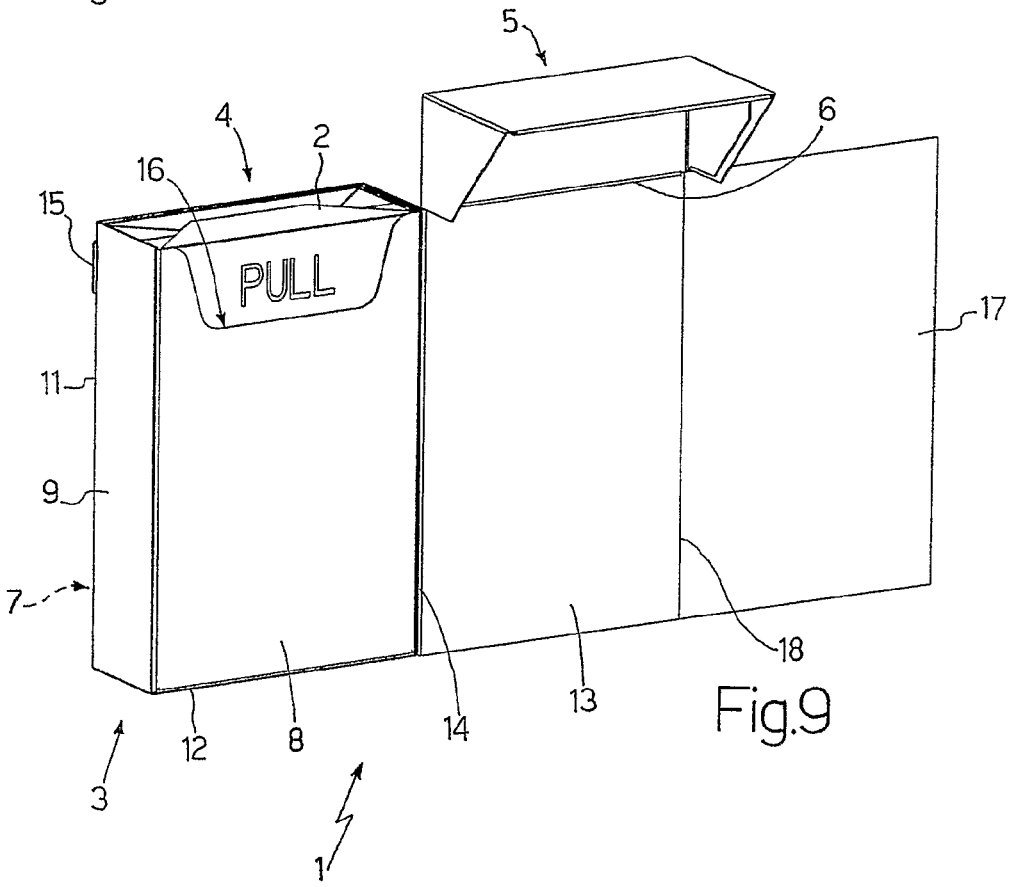
FIG. 9 shows a front view in perspective of the FIG. 8 rigid cigarette packet in a further open configuration.

In the FIGS. 8 and 9 embodiment, hinge 6 of lid 5 is located on additional panel 13, which, when in the folded position, rests on major lateral wall 8 or rear wall 8 of container 3. When additional panel 13 is in the folded position, hinge 6 of lid 5 is parallel to transverse edges 12, and is located at a top perimeter line of major lateral wall 8 or rear wall 8 of container 3. Hinge 14 of additional panel 13 is parallel to longitudinal edges 11 and coincident with one of the longitudinal edges 11 extending along major lateral wall 8 or rear wall 8 of container 3.

Major lateral wall 7 or front wall 7 of container 3 comprises two projections 15, which project laterally from major lateral wall 7, and engage respective inner surfaces of lid 5 when lid 5 is in the closed position.

As shown in FIGS. 8 and 9, a top portion of major lateral wall 8 or rear wall 8 of container 3 has a recess 16. Alternatively, a top portion of only major lateral wall 7 or also of major lateral wall 7 may comprise a recess 16.

Figure 10:
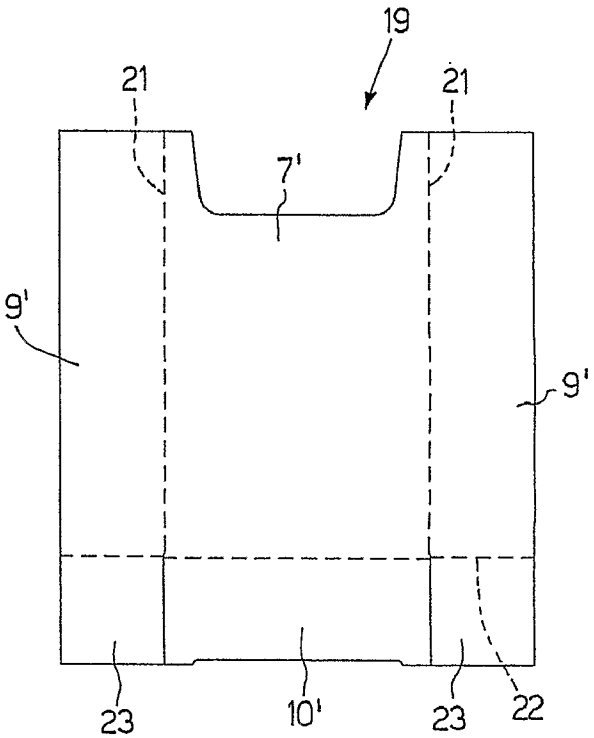
FIGS. 10 and 11 show plan views of two blanks by which to produce the rigid cigarette packet in FIGS. 8 and 9.
Figure 11:
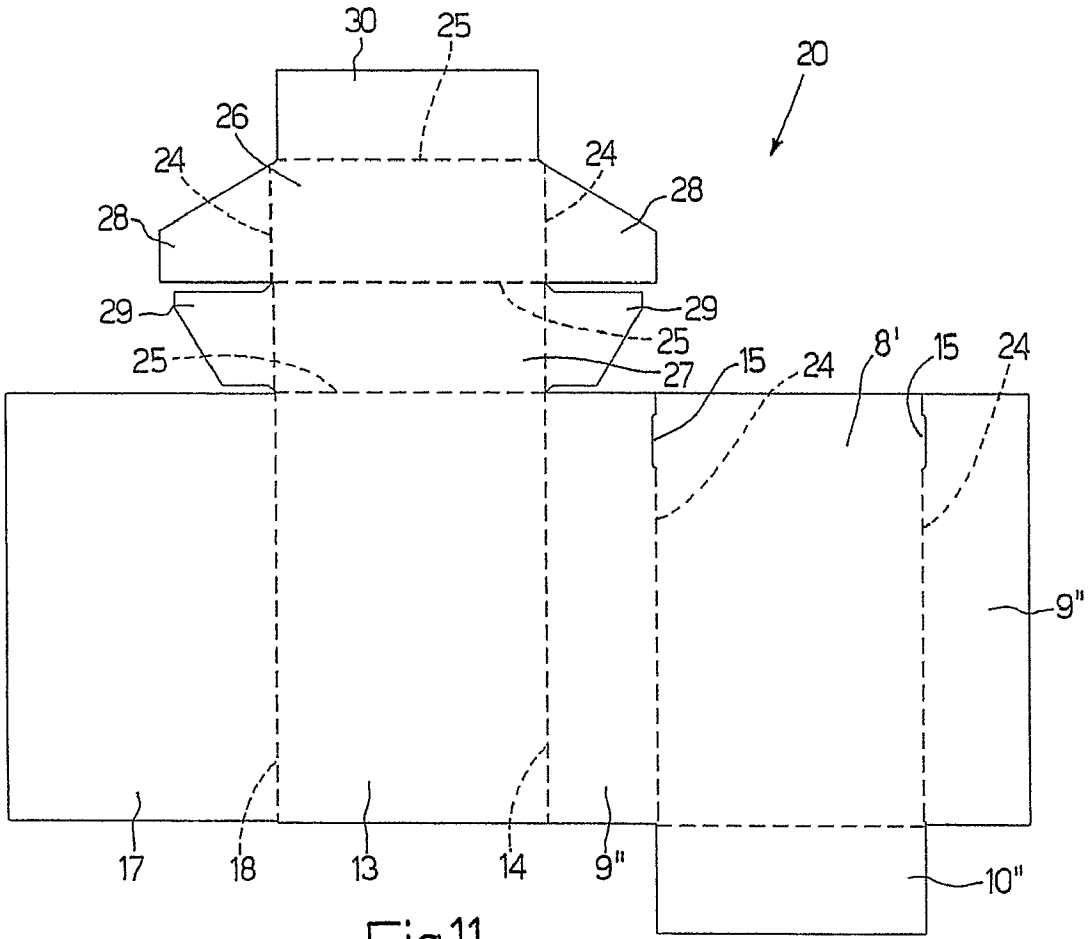

The FIG. 10 blank 19 for producing packet 1 in FIGS. 8 and 9 is identical with the FIG. 6 blank 19 for producing packet 1 in FIGS. 1 to 5; whereas the FIG. 11 blank 20 for producing packet 1 in FIGS. 8 and 9 is similar to, but not identical with, the FIG. 7 blank 20 for producing packet 1 in FIGS. 1 to 5.

Figure 12:
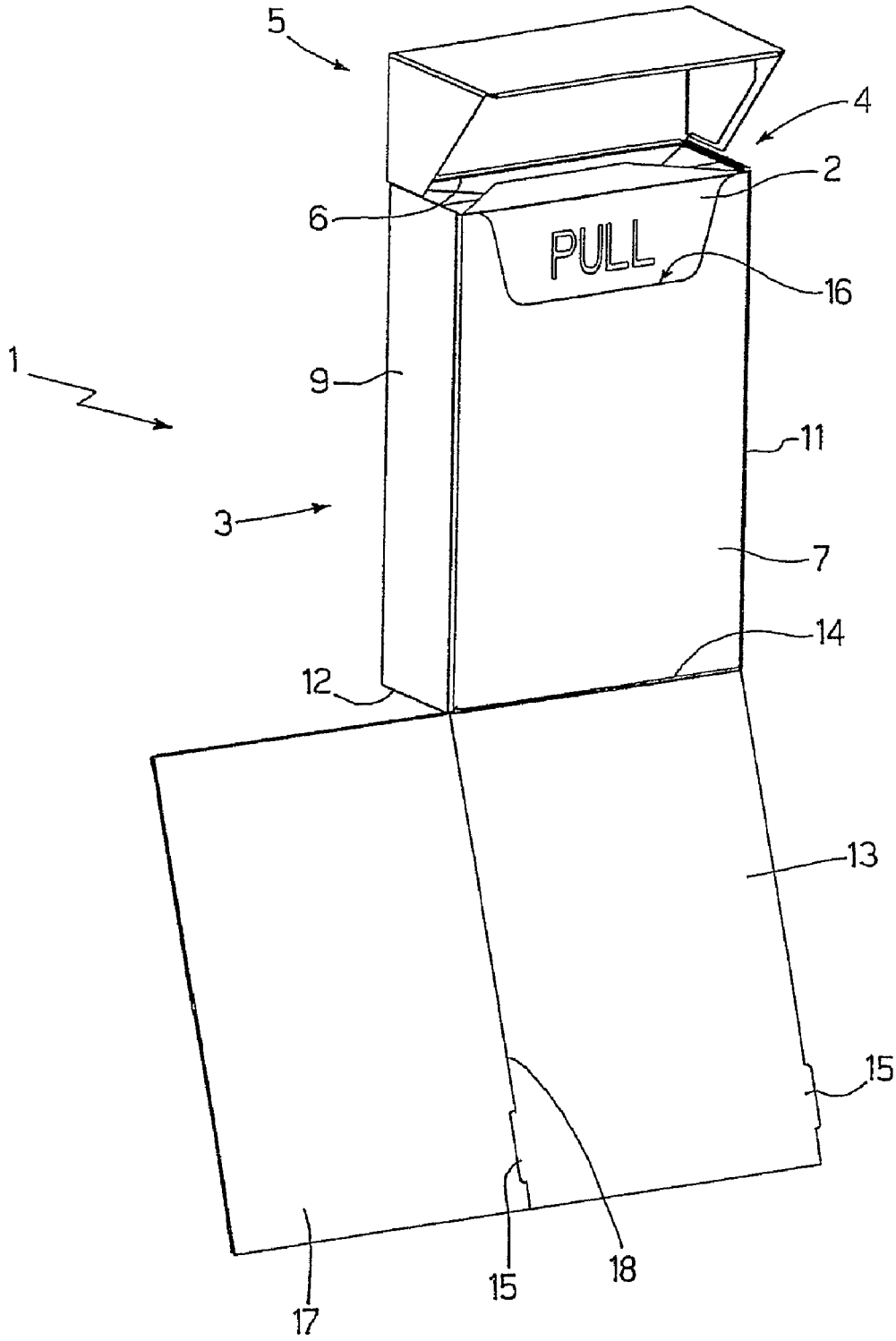
FIG. 12 shows a front view in perspective of a rigid cigarette packet in accordance with the present invention and in an open configuration.
Figure 14:
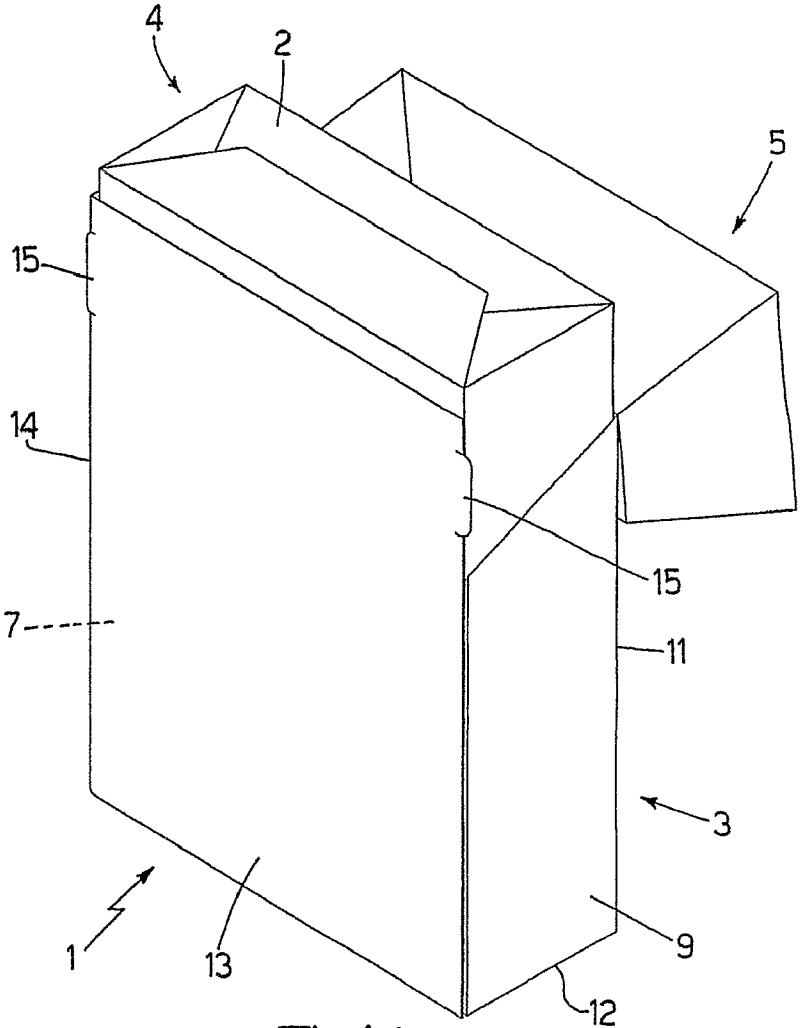
FIGS. 14 and 15 show two front views in perspective of the FIG. 13 rigid cigarette packet in a partly-open configuration.
Figure 13:
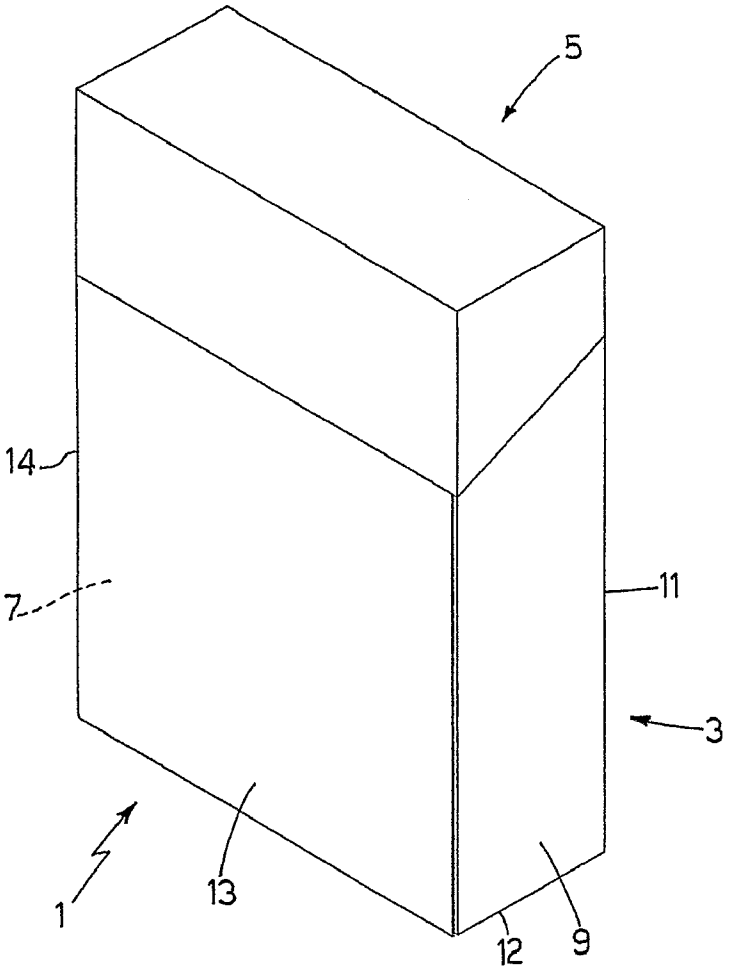
FIG. 13 shows a front view in perspective of a rigid cigarette packet in accordance with the present invention and in a closed configuration.
Figure 16:
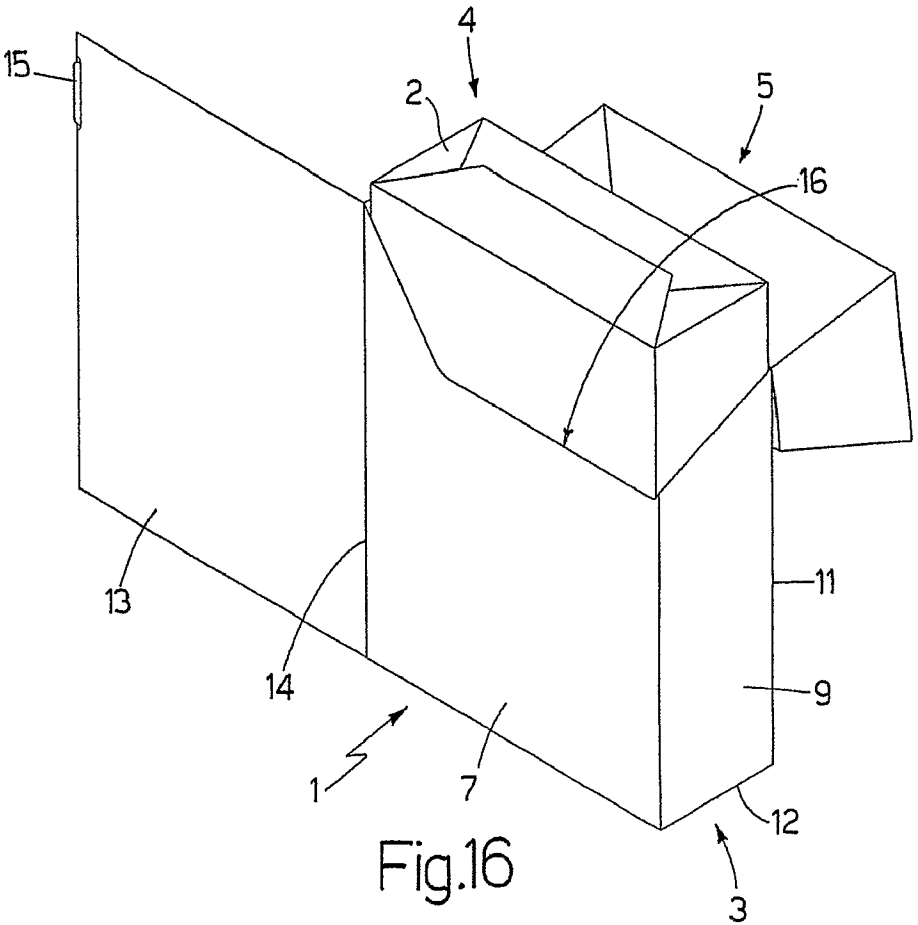
FIG. 16 shows a front view in perspective of the FIG. 13 rigid cigarette packet in an open configuration.
Figure 15:
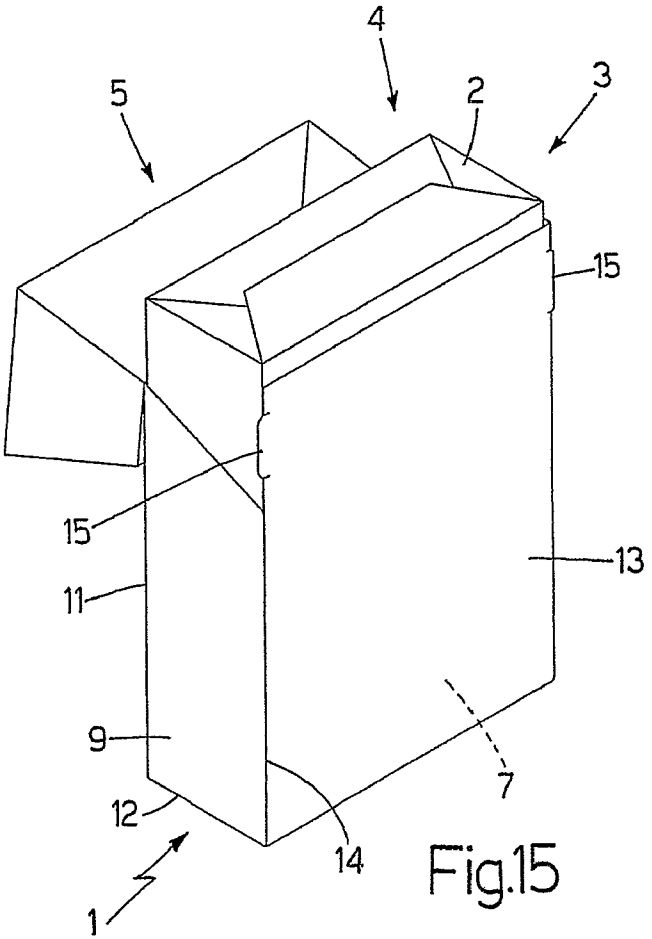

Blank 20 in FIG. 11 comprises a number of longitudinal fold lines 24; and a number of transverse fold lines 25 defining, between two longitudinal fold lines 24, a panel 26 defining a front wall of lid 5, a panel 27 defining a top wall of lid 5, and additional panel 13. Blank 20 also comprises a panel 8' defining major lateral wall 8 or rear wall 8 of container 3; and a panel 10" defining part of bottom wall 10 of container 3. Panel 8' comprises two wings 9", which define respective parts of minor lateral walls 9 of container 3, are located on opposite sides of panel 8', and are separated from panel 8' by longitudinal fold lines 24; b In the FIG. 12 embodiment, hinge 14 of additional panel 13 is parallel to transverse edges 12 and coincident with the transverse edge 12 extending across major lateral wall or front wall 7 of container 3.

In a further embodiment not shown, hinge 14 of additional panel 13 is parallel to transverse edges 12 and located on front wall 7 at recess 16. That is, additional panel 13 is connected to front wall 7 of the container by hinge 14, which is parallel to transverse edges 12 and located on front wall 7 at recess 16. Additional panel 13 preferably has a transverse dimension smaller than the transverse dimension of front wall 7, and in particular has a transverse dimension substantially equal to the transverse dimension of recess 16.

In a further embodiment not shown, a collar is located inside container 3, and projects partly from top open end 4 of container 3. In which case, hinge 14 of additional panel 13 may be formed on the collar, so as to be parallel to transverse edges 12 and located at recess 16. Additional panel 13 preferably has a transverse dimension smaller than the transverse dimension of front wall 7, and in particular has a transverse dimension substantially equal to the transverse dimension of recess 16.

In an alternative embodiment not shown, the top portions of major lateral wall 7 and minor lateral walls 9 of container 3 which come into contact with lid 5, when lid 5 is in the closed position, may be debossed, so as to be depressed with respect to the rest of major lateral wall 7 and minor lateral walls 9 of container 3, and so prevent the formation of a step between the bottom edge of lid 5 and lateral walls 7 and 9 of container 3 when lid 5 is in the closed position.

A releasable fastening system may be provided between additional panel 13 and respective major lateral wall 7 or 8 of container 3, to keep additional panel 13 in contact with major lateral wall 7 or 8 of container 3 with a certain amount of force when additional panel 13 is in the folded position. Such a releasable fastening system may be defined, for example, by one or more spots of adhesive, or by a slit formed in major lateral wall 7 or 8 of container 3 to receive a bottom edge of additional panel 13 (in which case, additional panel 13 is slightly smaller than major lateral walls 7 and 8 of container 3).

In the embodiment shown in the accompanying drawings, longitudinal edges 11 and transverse edges 12 are sharp, square edges. In an alternative embodiment not shown, some of longitudinal edges 11 and/or some of transverse edges 12 are non-square, rounded or bevelled edges. For example, longitudinal edges 11 may be non-square, rounded or bevelled edges, or (as in the packet of cigarettes described in Patent Application EP-A1-0764595) the major transverse edges 12 (i.e. between bottom wall 10 and major lateral walls 7 and 8) may be non-square, rounded or bevelled edges. Alternatively, some longitudinal edges 11 and some transverse edges 12 may be non-square, rounded edges, so as to have both non-square, rounded or bevelled longitudinal edges 11 and non-square, rounded or bevelled transverse edges 12.

In an alternative embodiment not shown, container 3 may be shaped as in the packet of cigarettes described in Patent Application EP-A1-1066205; in which case, each major lateral wall 7, 8 is outwardly convex, and has a flat central portion, and two curved, pre-weakened lateral bands connecting the flat central portion to minor lateral walls 9 at respective sharp, non-square longitudinal edges 11.

Both additional panel 13 and further panel 17, if provided, may preferably be printed with drawings, photographs, symbols or texts; for which purpose, the surfaces of additional panel 13 and further panel 17 which are superimposed when panel 13 is in the folded position are preferably not glazed.

With respect to the FIG. 1-5 embodiment, the FIG. 13-16 embodiment has no further panel 17 hinged to panel 13, minor lateral walls 9 of container 3 are smaller in height than rear wall 8 of container 3 to facilitate withdrawal of the cigarettes from container 3, and recess 16 of front wall 7 of container 3 is asymmetrical and more pronounced at the longitudinal edge 11 opposite hinge 14 of additional panel 13.

More specifically, the top edge of each minor lateral wall 9 is substantially coincident with the equivalent bottom edge of lid 5 when lid 5 is in the closed position (FIG. 13) closing open end 4. The top edge of each minor lateral wall 9 therefore slopes, and each minor lateral wall 9 is in the form of a right-angle trapezium having the major base at rear wall 8 of container 3.

In the FIG. 13-16 embodiment, there is no collar inside container 3. An alternative embodiment, shown in FIGS. 17-27, comprises a collar 31, which is folded into a U and glued to the inside of container 3 to project partly outwards of open top end 4 and engage a corresponding inner surface of lid 5 when lid 5 is in the closed position. The top edge of collar 31 is depressed to define a recess 32 to facilitate withdrawal of the cigarettes from container 3. In a preferred embodiment, recess 32 of collar 31 is asymmetrical like recess 16 of front wall 7 of container 3. More specifically, recess 32 of collar 31 is only present at front wall 7 of container 3 and at the minor lateral wall 9 opposite hinge 14 of additional panel 13. In other words, recess 32 is not present at the minor lateral wall 9 featuring hinge 14 of additional panel 13.

The FIG. 13-16 embodiment has no fastening member for holding additional panel 13 on front wall 7 of container 3 when lid 5 is in the open position opening open top end 4 of container 3. An alternative embodiment, shown in FIGS. 19-29, comprises a releasable fastening system 33 for holding additional panel 13 on front wall 7 of container 3 when lid 5 is in the open position opening open top end 4 of container 3.

In the embodiment shown in FIGS. 17, 18, 23 and 24, releasable fastening system 33 comprises a replaceable adhesive tab 34, which is connected permanently to a minor lateral wall 9 of container 3 and releasably to additional panel 13. To rotate additional panel 13 about hinge 14, adhesive tab 34 is detached from additional panel 13; and, to hold additional panel 13 on front wall 7 of container 3, adhesive tab 34 is stuck to additional panel 13.

In the embodiment shown in FIGS. 19-22 and 25-27, releasable fastening system 33 comprises a tongue 35 projecting laterally from additional panel 13; and a slit 36 for receiving tongue 35, and which is formed through front wall 7 of container 3, at a longitudinal edge 11, so as to face tongue 35 when additional panel 13 is positioned contacting front wall 7. To rotate additional panel 13 about hinge 14, tongue 35 is extracted from slit 36; and, to hold additional panel 13 on front wall 7 of container 3, tongue 35 is inserted inside slit 36. A certain amount of shape/dimensional interference may be provided between tongue 35 and slit 36, so that a certain amount of flexing of tongue 35 is required to withdraw tongue 35 from slit 36.

Figure 29:
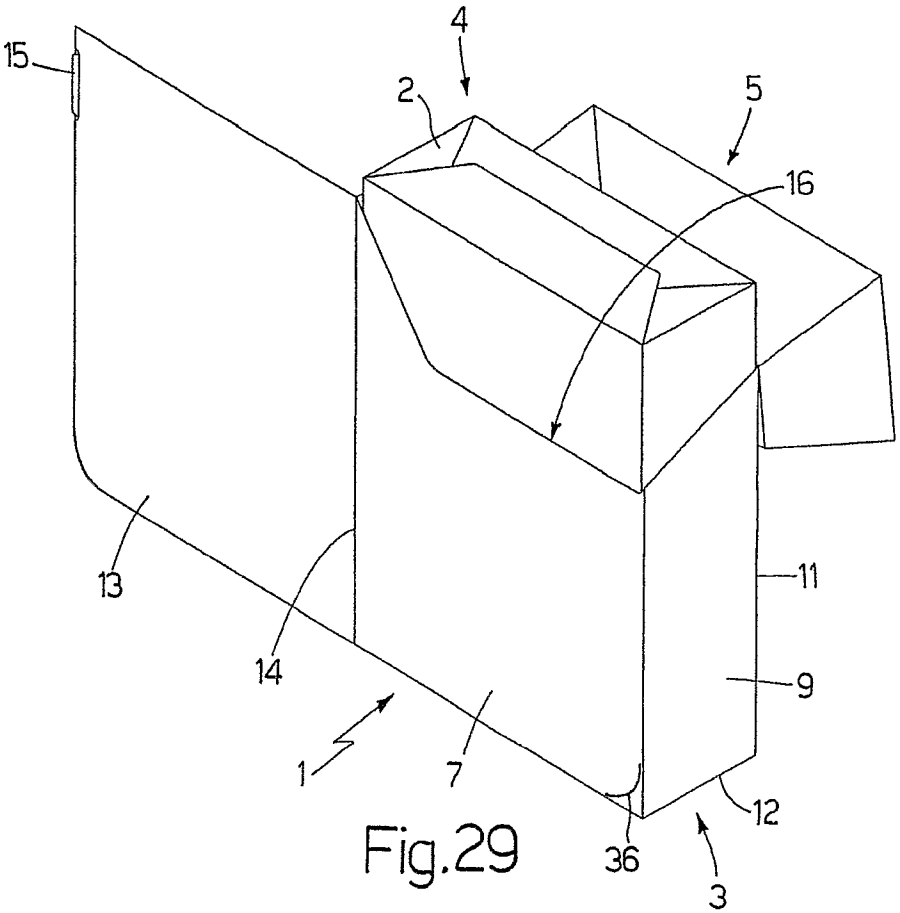
FIGS. 28 and 29 show front views in perspective of a variation of the FIG. 13 rigid cigarette packet in a closed configuration and an open configuration.
Figure 28:
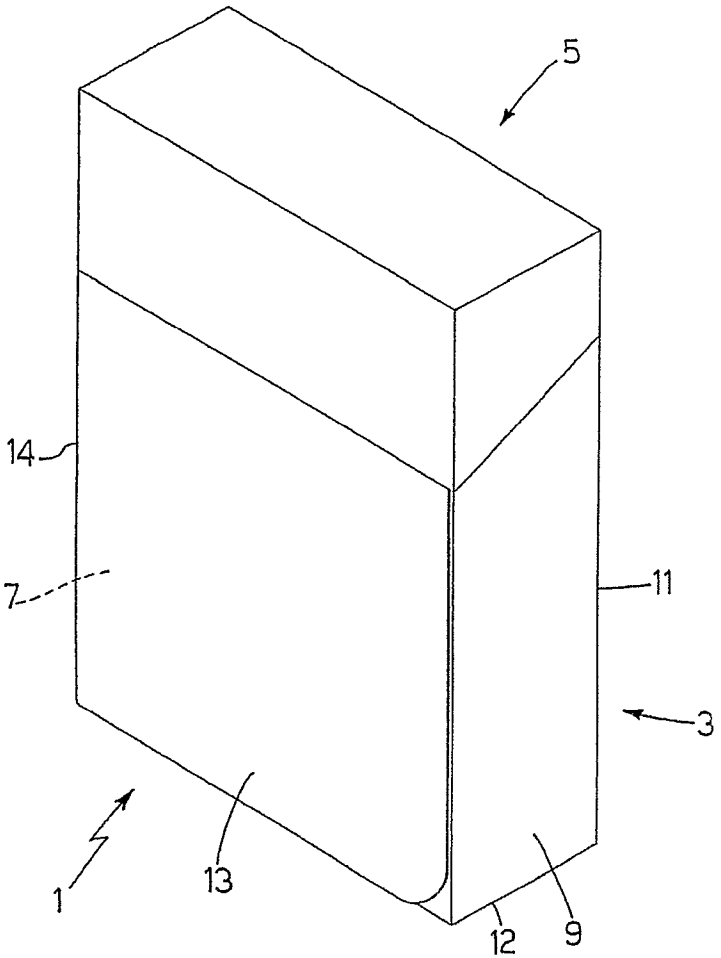

In the embodiment shown in FIGS. 28 and 29, releasable fastening system 33 comprises a slit 36 for receiving an end corner portion of additional panel 13, and which is formed through front wall 7 of container 3, close to where the longitudinal edge 11 opposite hinge 14 of additional panel 13 meets the bottom transverse edge 12. In a preferred embodiment shown in FIGS. 28 and 29, slit 36 and the end corner portion of additional panel 13 inserted inside slit 36 are rounded.

Figure 17:
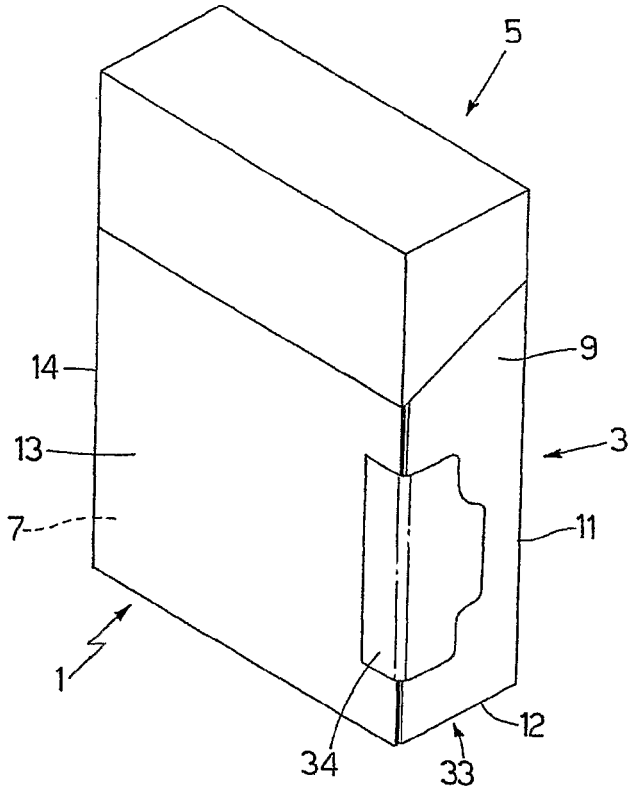
FIGS. 17 and 18 show front views in perspective of a variation of the FIG. 13 rigid cigarette packet in a closed configuration and an open configuration.
Figure 18:
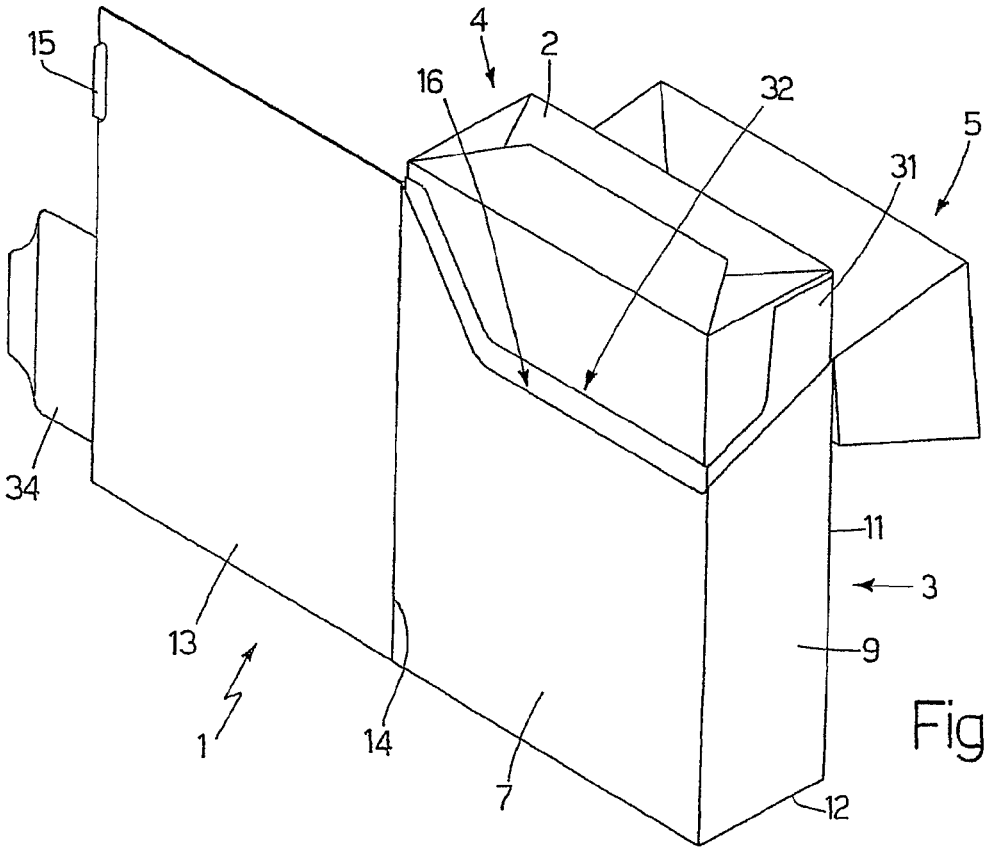

Packet 1 in FIGS. 17 and 18 differs from packet 1 in FIGS. 13-16 by comprising collar 31 and releasable fastening system 33 comprising adhesive tab 34.

Figure 19:
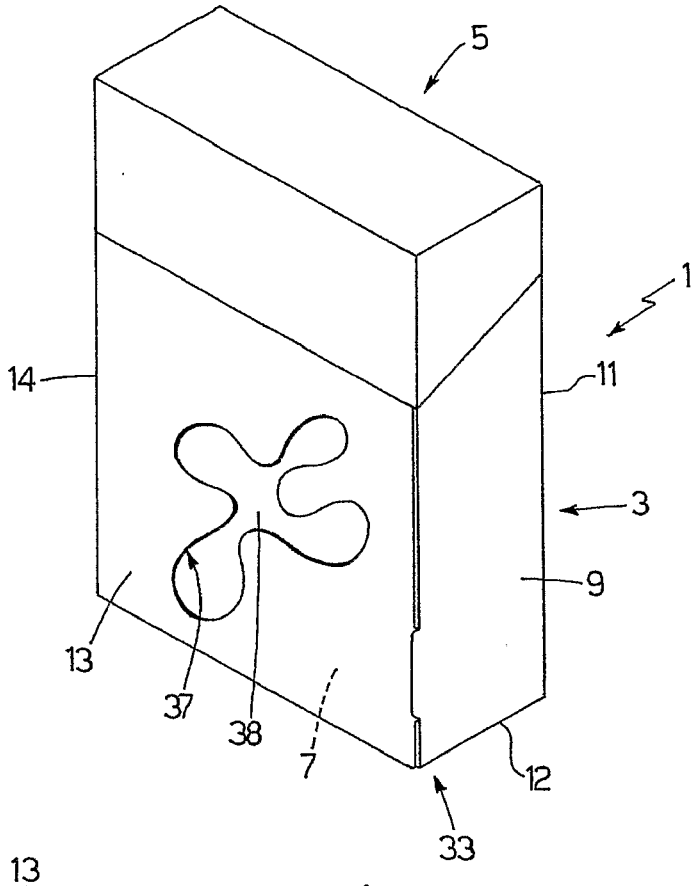
FIGS. 19 and 20 show front views in perspective of a variation of the FIG. 13 rigid cigarette packet in a closed configuration and an open configuration.
Figure 20:
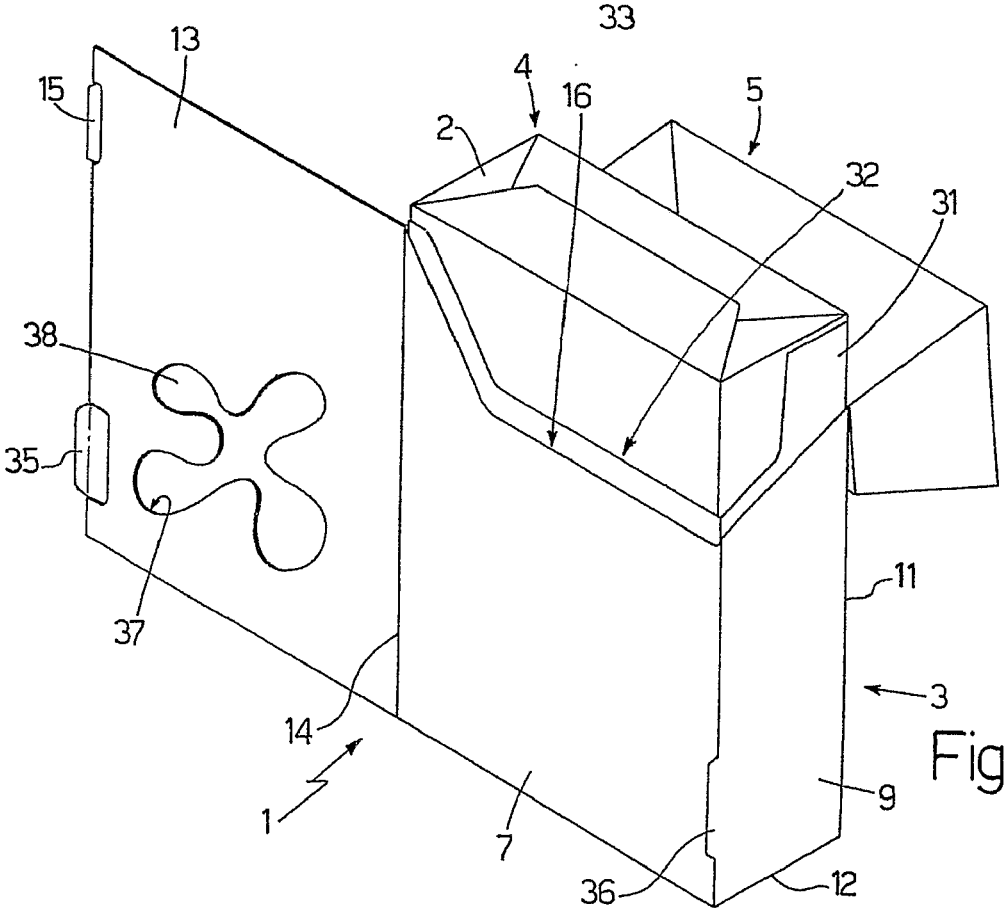

In the embodiment shown in FIGS. 19 and 20, additional panel 13 comprises a central through hole 37, through which a corresponding underlying portion of front wall 7 of container 3 is visible when additional panel 13 is positioned contacting front wall 7. Hole 37 may be clear, or may be closed by a sheet 38 of transparent or semitransparent material glued to the inside or back of additional panel 13. Hole 37 may also be in the form of an image (not shown) printed on front wall 7 of container 3.

Figure 21:
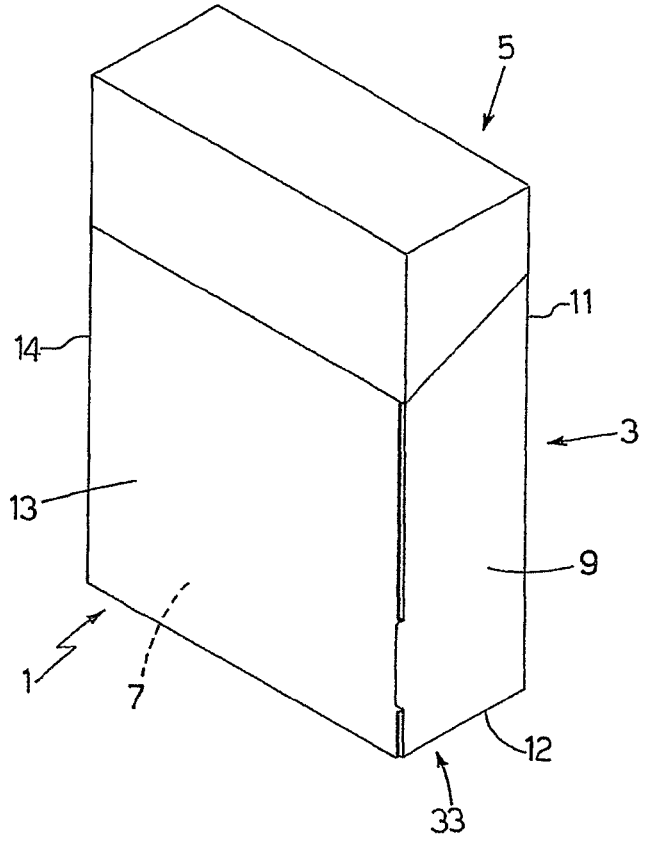
FIGS. 21 and 22 show front views in perspective of a variation of the FIG. 13 rigid cigarette packet in a closed configuration and an open configuration.
Figure 22:
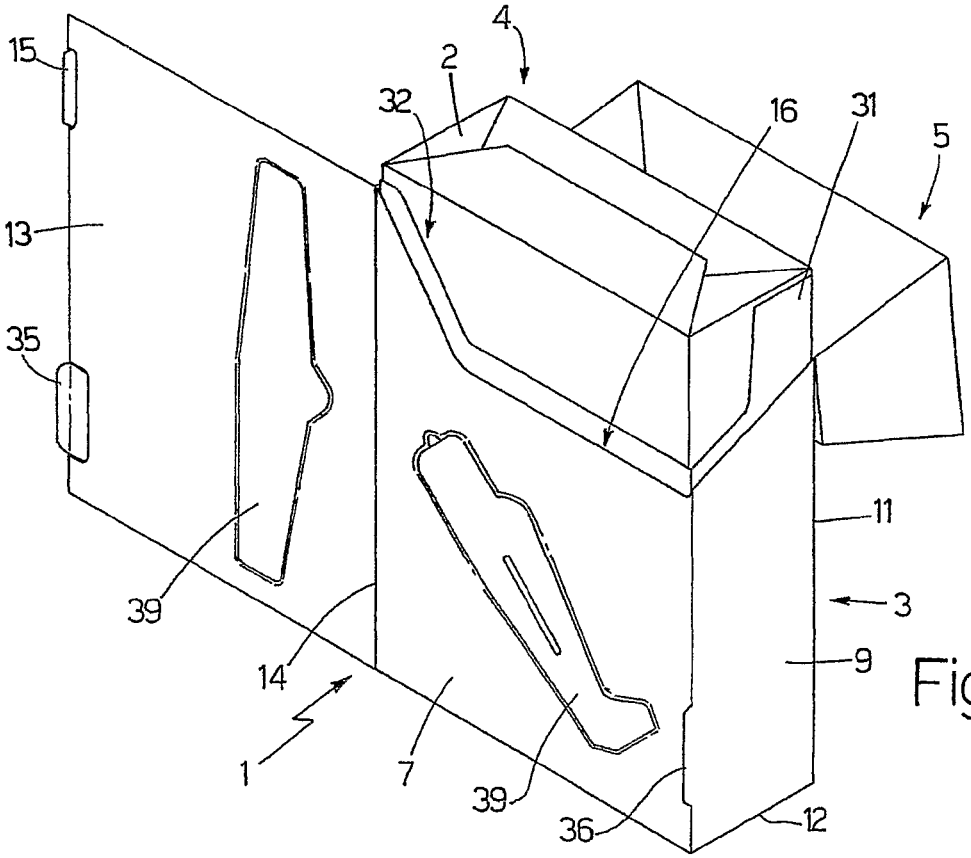

In the embodiment shown in FIGS. 21 and 22, the pieces 39 of a buildable item; e.g. a small aeroplane (not shown assembled), can be torn off additional panel 13 and/or front wall 7 of container 3. In other words, the outlines of pieces 39 of a buildable item are precut into additional panel 13 and/or front wall 7 of container 3, so pieces 39 can be torn off.

Figure 23:
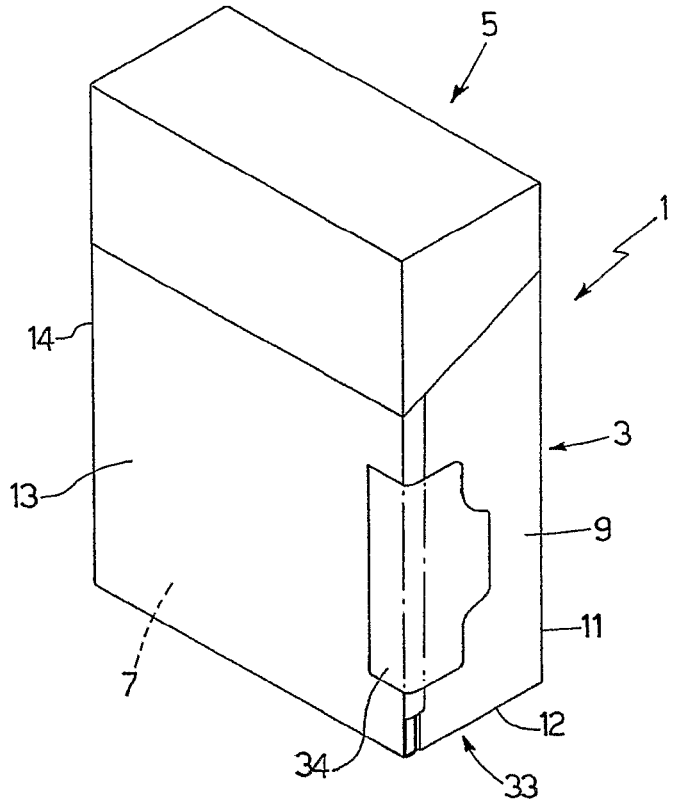
FIGS. 23 and 24 show front views in perspective of a variation of the FIG. 13 rigid cigarette packet in a closed configuration and an open configuration.
Figure 24:
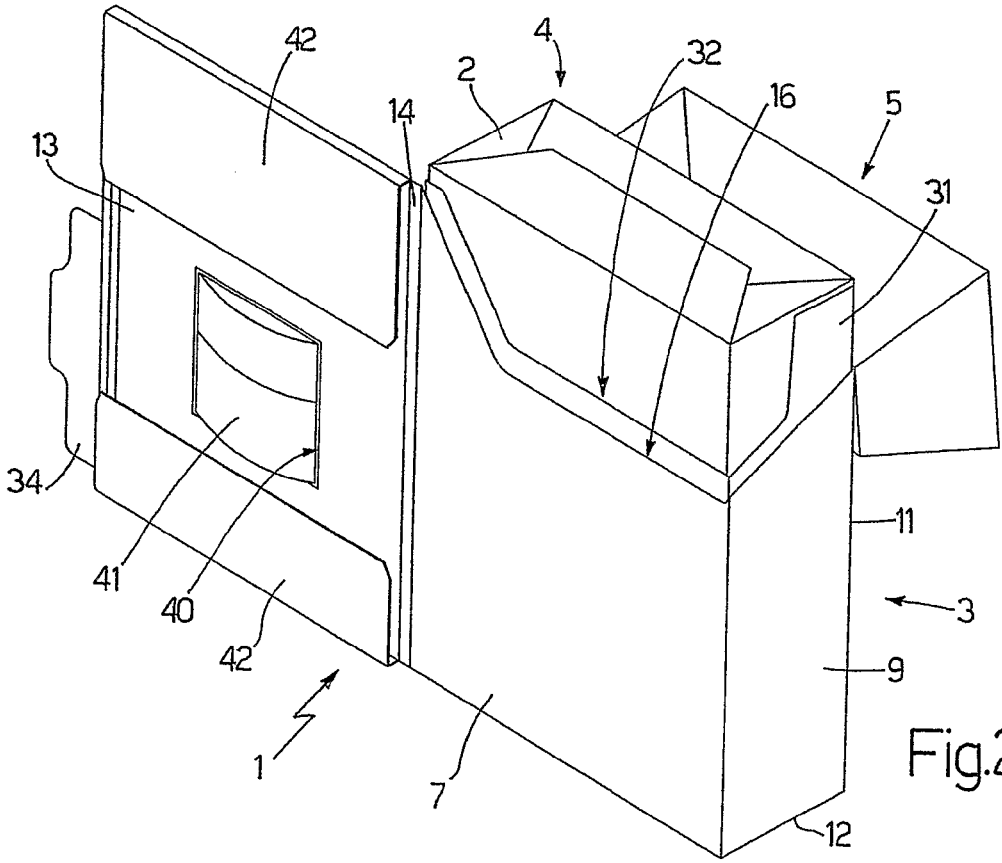

In the embodiment shown in FIGS. 23 and 24, a seat 40 is formed on an inner surface of additional panel 13 to hold a small object 41 e.g. a perfume sample, cosmetic sample, or confectionary product. To allow for the thickness of object 41, additional panel 13 comprises two tabs 42 to keep additional panel 13 raised with respect to front wall 7 of container 3 when additional panel 13 is positioned against front wall 7.

Figure 25:
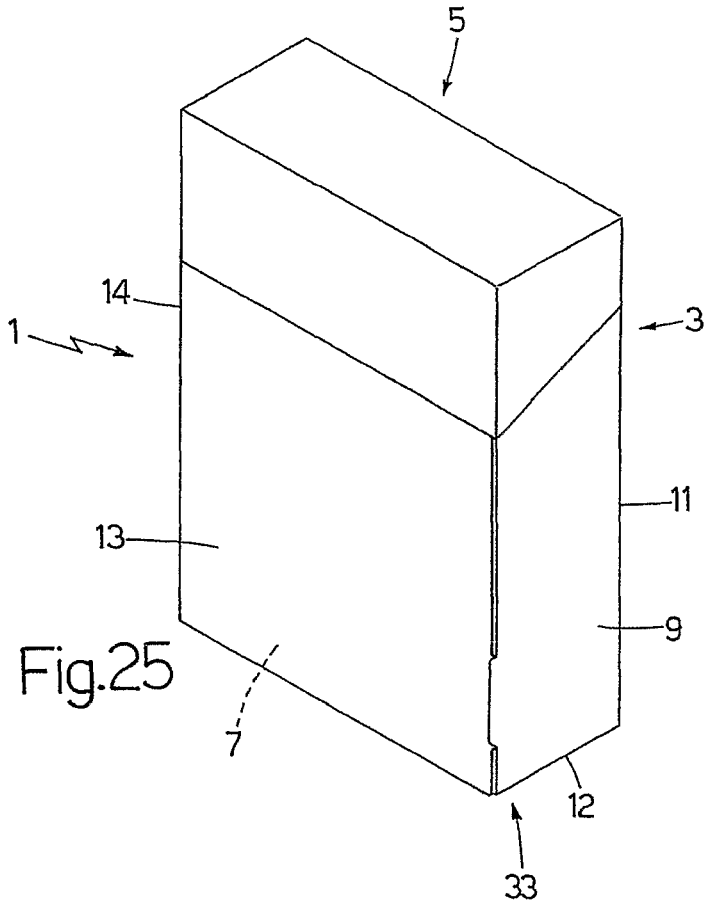
FIGS. 25, 26 and 27 show front views in perspective of a variation of the FIG. 13 rigid cigarette packet in a closed configuration and two open configurations.
Figure 26:
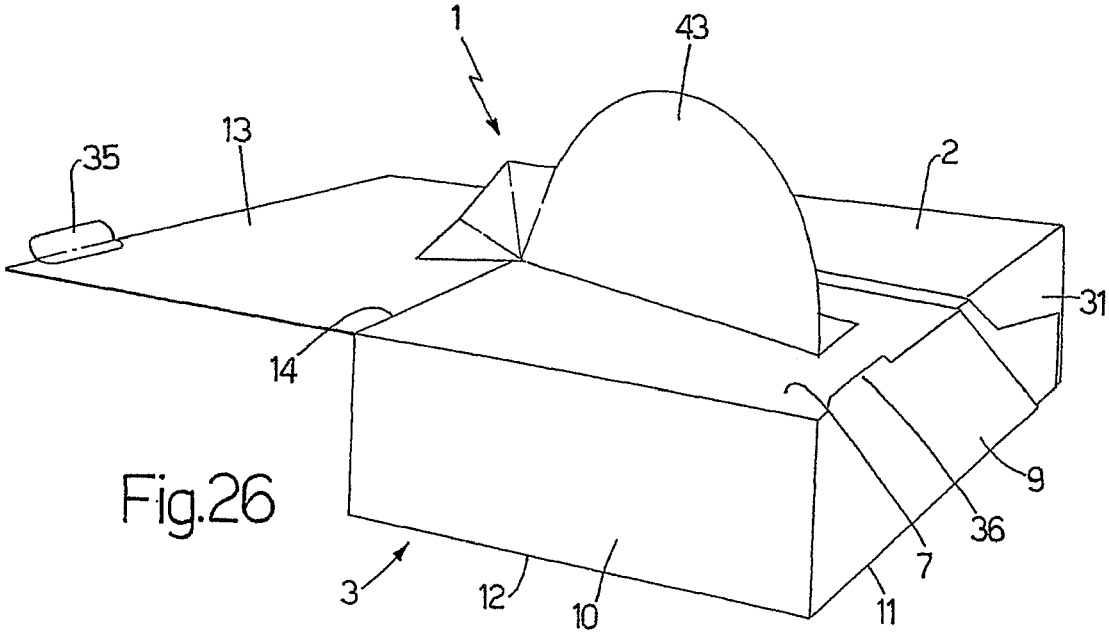
Figure 27:
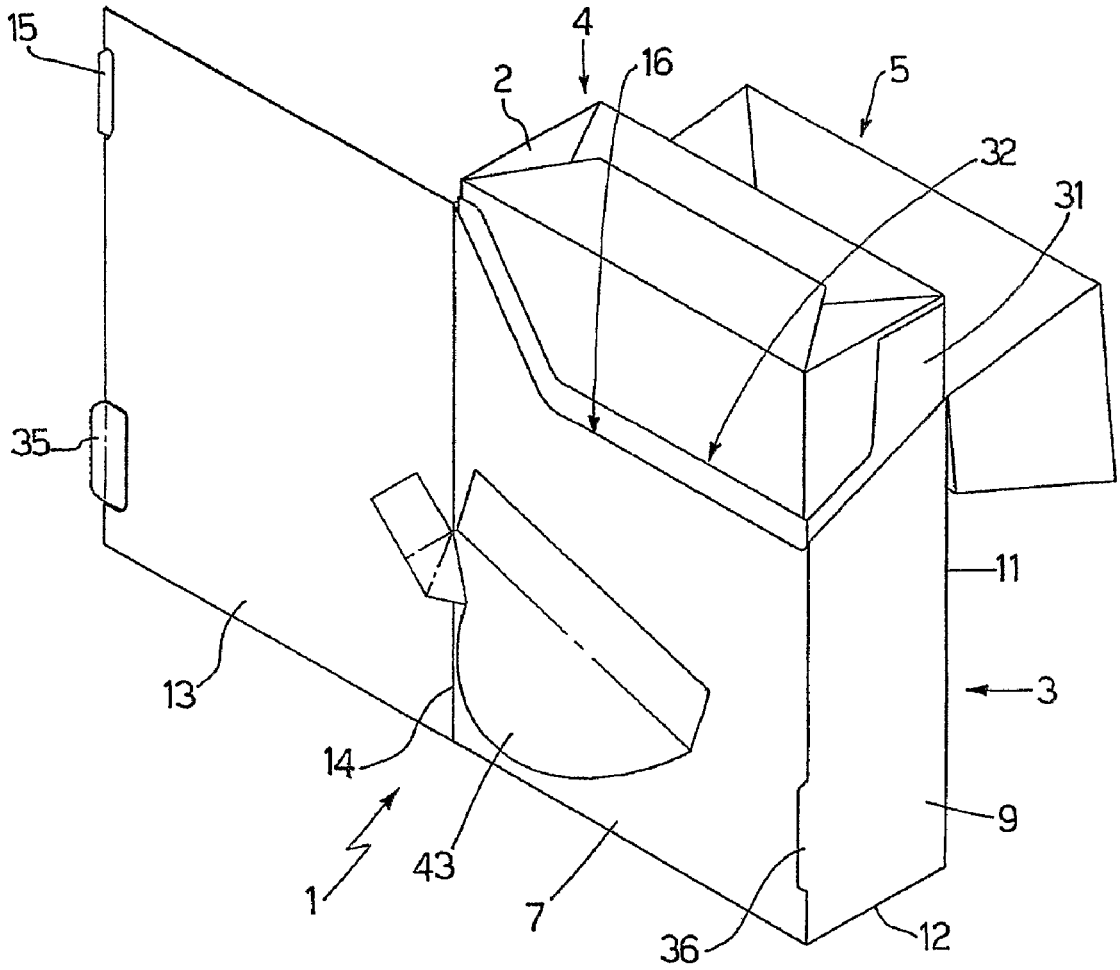

In the FIG. 25-27 embodiment, a movable insert 43 is connected to front wall 7 of container 3, is parallel to and rests on front wall 7 when additional panel 13 is positioned against front wall 7, and is erected perpendicular to front wall 7 when additional panel 13 is detached from front wall 7. More specifically, a marginal portion of movable insert 43 is fixed to an inner surface of additional panel 13, so that movable insert 43 is moved automatically as additional panel 13 rotates about hinge 14. In an alternative embodiment not shown, movable insert 43 is connected to additional panel 13 as opposed to front wall 7.

Figures 30, 31:
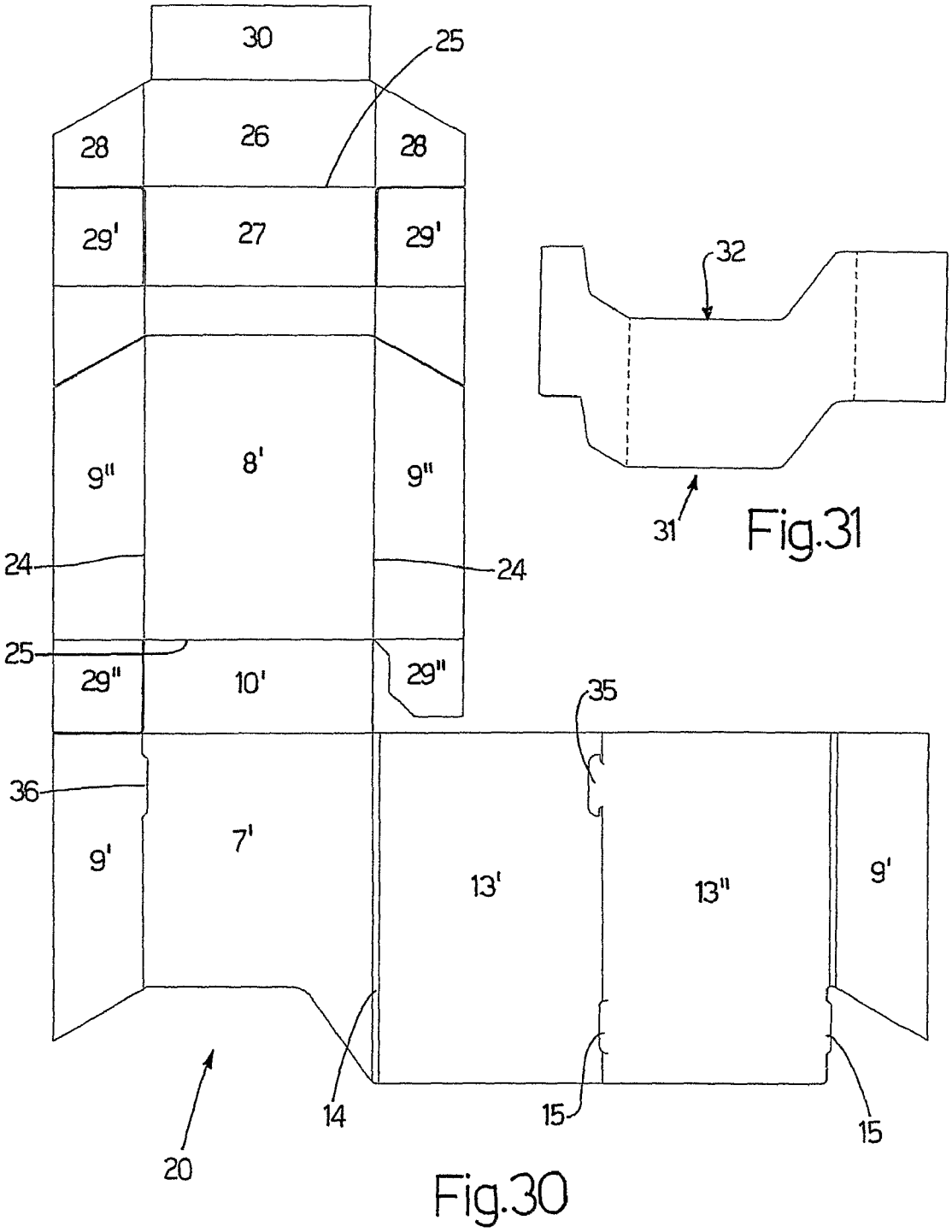
FIGS. 30 and 31 show a plan view of a blank and a plan view of a collar by which to produce the rigid cigarette packet in FIGS. 13-29.

As shown in FIG. 30, containers 3 in FIGS. 13 to 29 can be formed from a flat blank 20, the component parts of which are indicated where possible using the same reference numbers, with superscripts, as for the corresponding parts of container 3.

Blank 20 comprises two longitudinal fold lines 24; and a number of transverse fold lines 25 defining, between the two longitudinal fold lines 24, a panel 26 defining a front wall of lid 5, a panel 27 defining a top wall of lid 5, a panel 8' defining major lateral wall 8 or rear wall 8 of container 3, a panel 10' defining bottom wall 10 of container 3, and a panel 7' defining major lateral wall 7 or front wall 7 of container 3.

Panel 8' has two wings 9", which define respective parts of minor lateral walls 9 of container 3, are located on opposite sides of panel 8', and are separated from panel 8' by longitudinal fold lines 24.

Additional panel 13 is defined by two panels 13' and 13", which are superimposed and glued one to the other; panel 13' is connected to panel 7' along hinge line 14 coincident with one of longitudinal fold lines 24, and panel 13" is connected to panel 13' along a longitudinal fold line parallel to longitudinal fold lines 24.

Preferably, panel 26 comprises two wings 28, which define the lateral walls of lid 5, are located on opposite sides of panel 26, and are separated from panel 26 by longitudinal fold lines 24; and each wing 9" comprises two further wings 29' and 29" separated from wing 9" by transverse fold lines 25. Panel 26 also comprises a reinforcing flap 30 which is folded onto panel 26.

Minor lateral walls 9 of container 3 are partially defined by two wings 91, a first of which is connected to panel 7' along a longitudinal fold line 24, and a second of which is connected to panel 13" along a longitudinal fold line parallel to longitudinal fold lines 24.

Figure 32:
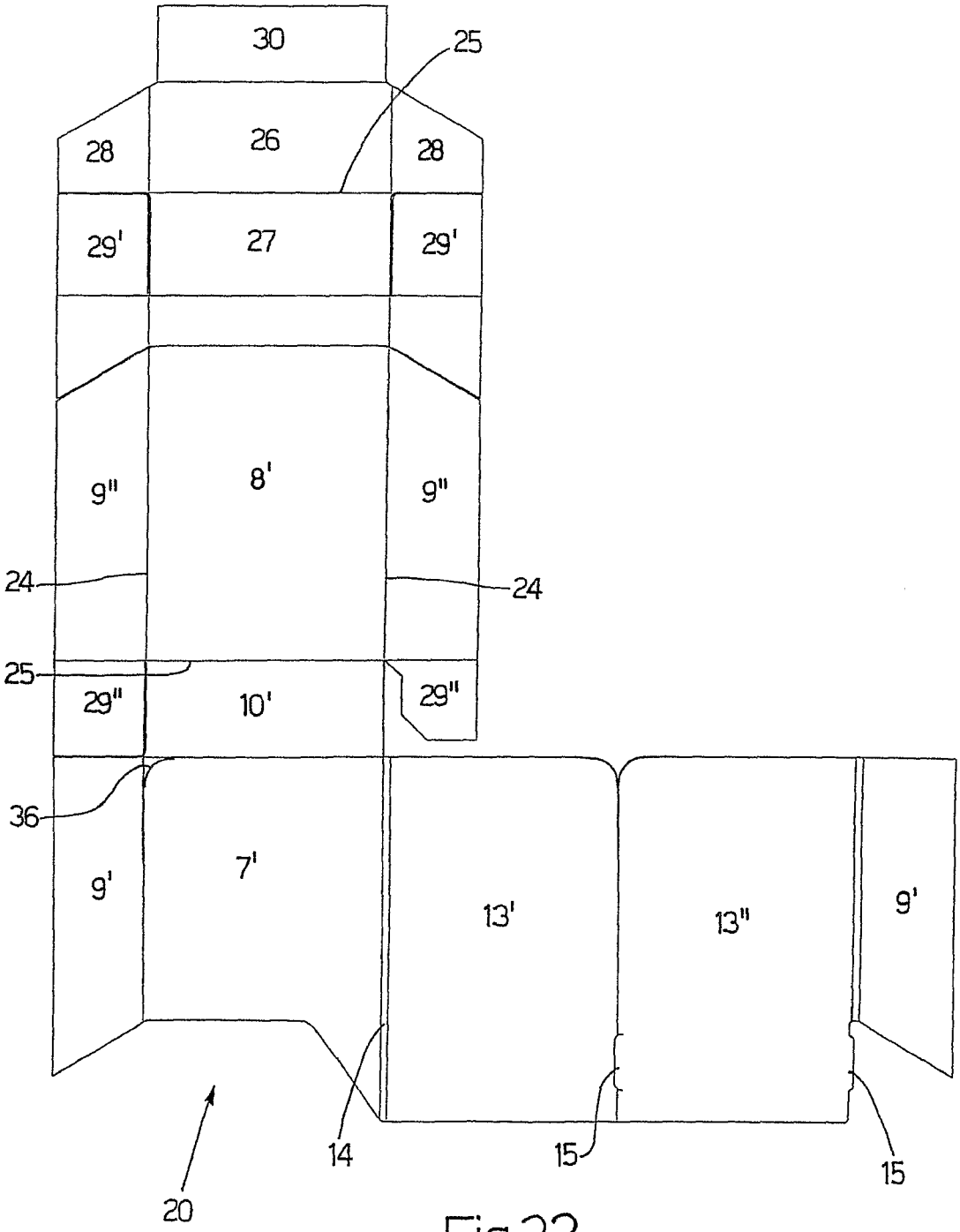
Figure 34:
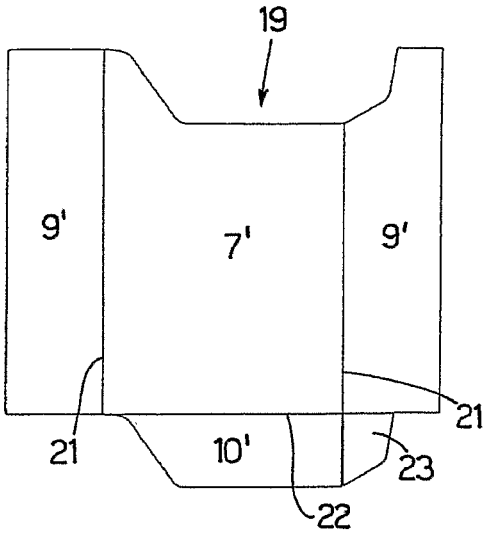
FIGS. 33 and 34 show plan views of two blanks by which to produce the rigid cigarette packet in FIGS. 13-29.
Figure 33:
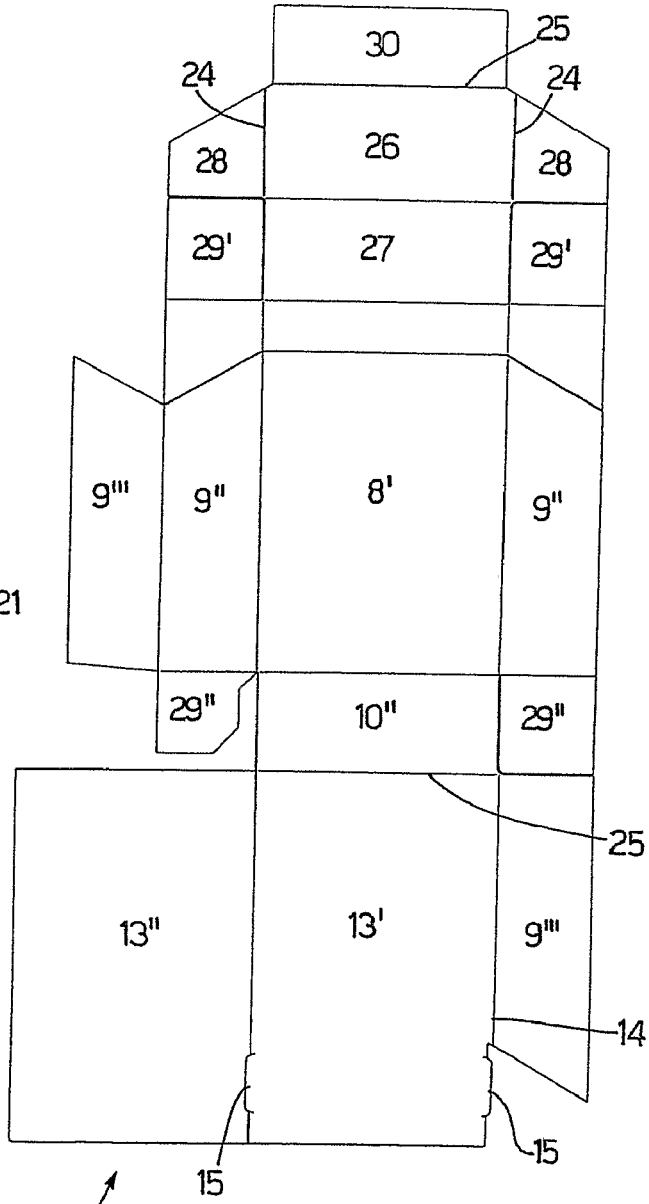
Figure 35:
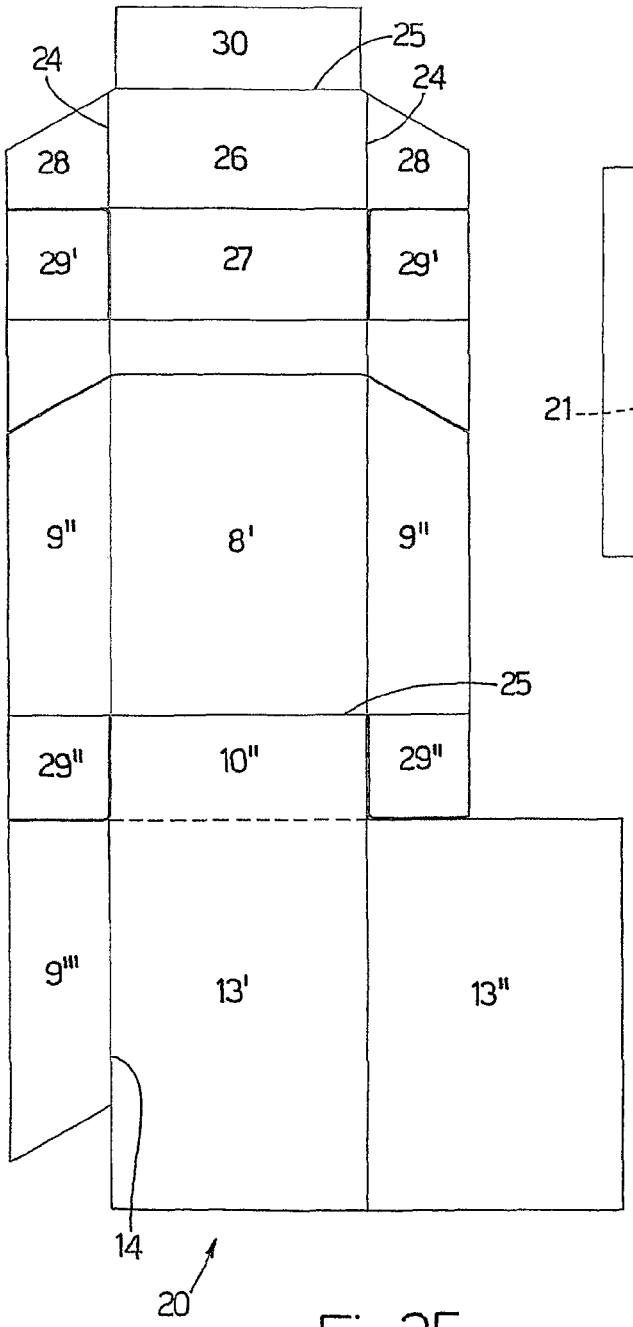
FIGS. 35 and 36 show plan views of two blanks by which to produce the rigid cigarette packet in FIGS. 13-29.
Figure 36:
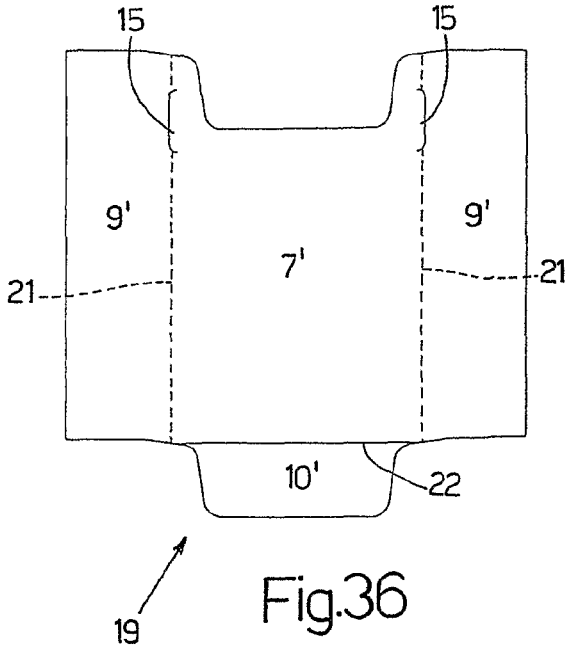

As shown in FIG. 32, containers 3 in FIGS. 13 to 29 can be formed from a flat blank 20, the component parts of which are indicated where possible using the same reference numbers, with superscripts, as for the corresponding parts of container 3. Blank 20 in FIG. 32 is almost identical to blank 20 in FIG. 30, the only difference being the presence of slit 36 in the FIG. 32 blank 20.

As shown in FIGS. 19 and 20, containers 3 in FIGS. 13 to 33 can be formed from two flat blanks 19 and 20, the component parts of which are indicated where possible using the same reference numbers, with superscripts, as for the corresponding parts of container 3.

Blank 19 comprises two longitudinal fold lines 21; and a transverse fold line 22 defining, between the two longitudinal fold lines 21, a panel 7' defining major lateral wall 7 or front wall 7 of container 3, and a second panel 10' defining part of bottom wall 10 of container 3. Panel 7' has two wings 9', which define respective parts of minor lateral walls 9 of container 3, are located on opposite sides of panel 7', and are separated from panel 7' by longitudinal fold lines 21; and one wing 9' has a tab 23 separated from wing 91 by transverse fold line 22.

Blank 20 comprises two longitudinal fold lines 24; and a number of transverse fold lines 25 defining, between the two longitudinal fold lines 24, a panel 26 defining a front wall of lid 5, a panel 27 defining a top wall of lid 5, a panel 8' defining major lateral wall 8 or rear wall 8 of container 3, a panel 10" defining part of bottom wall 10 of container 3, and a panel 13' defining part of additional panel 13.

Panel 8' has two wings 9", which define respective parts of minor lateral walls 9 of container 3, are located on opposite sides of panel 8', and are separated from panel 8' by longitudinal fold lines 24.

Preferably, panel 26 comprises two wings 28, which define the lateral walls of lid 5, are located on opposite sides of panel 26, and are separated from panel 26 by longitudinal fold lines 24; and each wing 9" comprises two further wings 29' and 29" separated from wing 9" by transverse fold lines 25. Panel 26 also comprises a reinforcing flap 30 which is folded onto panel 26.

Additional panel 13 is defined by two panels 13' and 13", which are superimposed and glued one to the other; panel 13" is connected to panel 13' along a longitudinal fold line 24. A further wing 9'" is connected to panel 13' along a longitudinal fold line 24, and a further wing 9'" is connected to a wing 9" along a longitudinal fold line parallel to longitudinal fold lines 24.

As shown in FIGS. 21 and 22, containers 3 in FIGS. 13 to 33 can be formed from two flat blanks 19 and 20, the component parts of which are indicated where possible using the same reference numbers, with superscripts, as for the corresponding parts of container 3.

Blank 19 comprises two longitudinal fold lines 21; and a transverse fold line 22 defining, between the two longitudinal fold lines 21, a panel 7' defining major lateral wall 7 or front wall 7 of container 3, and a second panel 10' defining part of bottom wall 10 of container 3. Panel 7' has o wings 9', which define respective parts of minor lateral walls 9 of container 3, are located on opposite sides of panel 7', and are separated from panel 7' by longitudinal fold lines 21.

Blank 20 comprises two longitudinal fold lines 24; and a number of transverse fold lines 25 defining, between the two longitudinal fold lines 24, a panel 26 defining a front wall of lid 5, a panel 27 defining a top wall of lid 5, a panel 8' defining major lateral wall 8 or rear wall 8 of container 3, a panel 10" defining part of bottom wall 10 of container 3, and a panel 13' defining part of additional panel 13.

Panel 8' has two wings 9", which define respective parts of minor lateral walls 9 of container 3, are located on opposite sides of panel 8', and are separated from panel 8' by longitudinal fold lines 24.

Preferably, panel 26 comprises two wings 28, which define the lateral walls of lid 5, are located on opposite sides of panel 26, and are separated from panel 26 by longitudinal fold lines 24; and each wing 9" comprises two further wings 29' and 29" separated from wing 9" by transverse fold lines 25. Panel 26 also comprises a reinforcing flap 30 which is folded onto panel 26.

Additional panel 13 is defined by two panels 13' and 13", which are superimposed and glued one to the other; panel 13" is connected to panel 13' along a longitudinal fold line 24. A further wing 9'" is connected to panel 13' along a longitudinal fold line 24.

Figure 37:
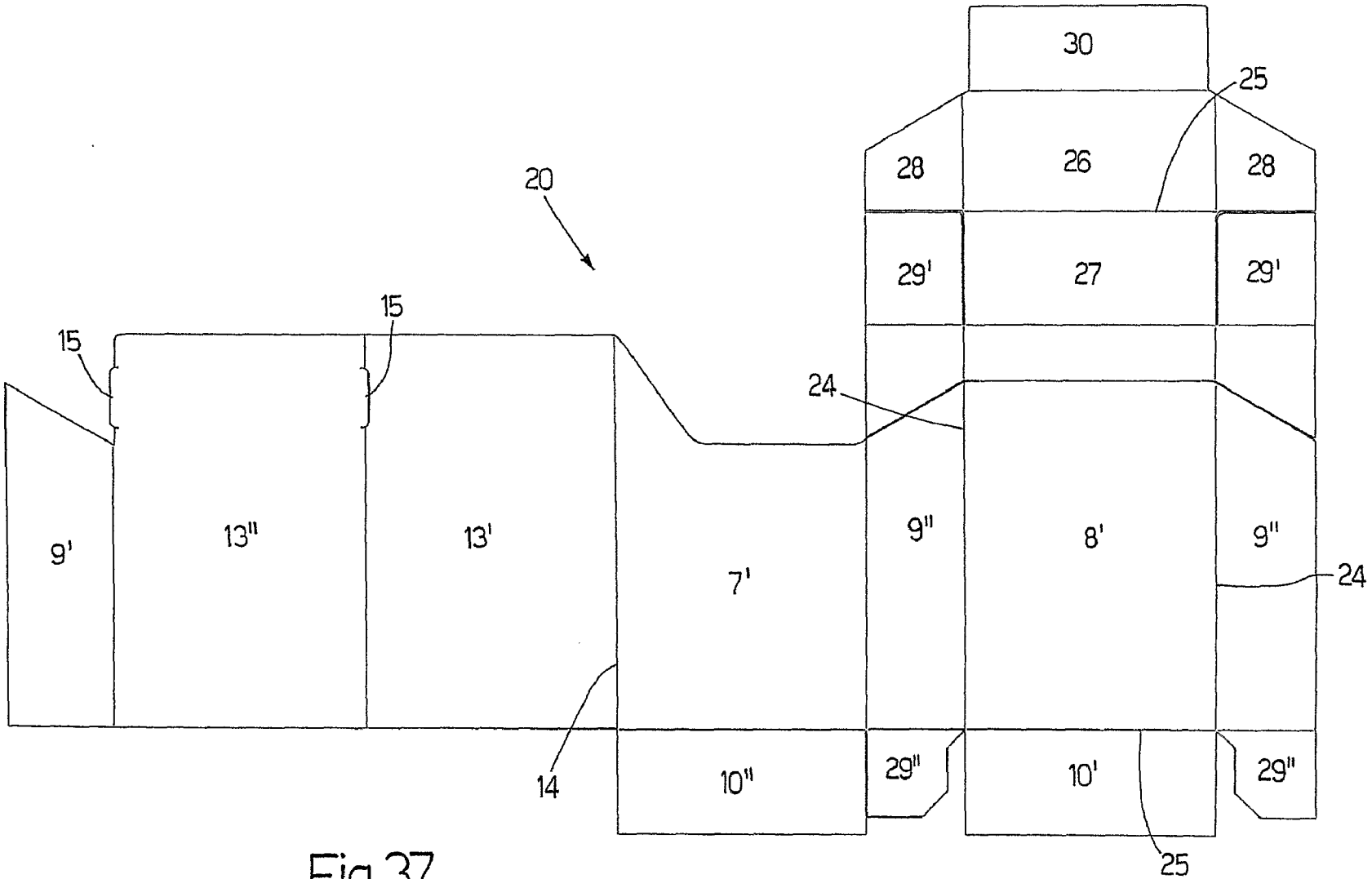
FIG. 37 shows a plan view of a further blank by which to produce the rigid cigarette packet in FIGS. 13-29.

As shown in FIG. 37, containers 3 in FIGS. 13 to 29 can be formed from a flat blank 20, the component parts of which are indicated where possible using the same reference numbers, with superscripts, as for the corresponding parts of container 3.

Blank 20 comprises two longitudinal fold lines 24; and a number of transverse fold lines 25 defining, between the two longitudinal fold lines 24, a panel 26 defining a front wall of lid 5, a panel 27 defining a top wall of lid 5, a panel 8' defining major lateral wall 8 or rear wall 8 of container 3, and a panel 10' defining part of bottom wall 10 of container 3.

Panel 8' has two wings 9", which define respective parts of minor lateral walls 9 of container 3, are located on opposite sides of panel 8', and are separated from panel 8' by longitudinal fold lines 24. A panel 7' defining major lateral wall 7 or front wall 7 of container 3 is connected to one of wings 9" along a longitudinal fold line parallel to longitudinal fold lines 24. A panel 10" defining part of bottom wall 10 of container 3 is connected to panel 7' along a transverse fold line 25.

Additional panel 13 is defined by two panels 13' and 13", which are superimposed and glued one to the other; panel 13' is connected to panel 7' along hinge line 14 parallel to longitudinal fold lines 24, and panel 13" is connected to panel 13' along a longitudinal fold line parallel to longitudinal fold lines 24. A further wing 9' defining part of a minor lateral wall 9 of container 3 is connected to panel 13" along a longitudinal fold line parallel to longitudinal fold lines 24.

Preferably, panel 26 comprises two wings 28, which define the lateral walls of lid 5, are located on opposite sides of panel 26, and are separated from panel 26 by longitudinal fold lines 24; and each wing 9" comprises two further wings 29' and 29" separated from wing 9" by transverse fold lines 25. Panel 26 also comprises a reinforcing flap 30 which is folded onto panel 26.

Figure 38:
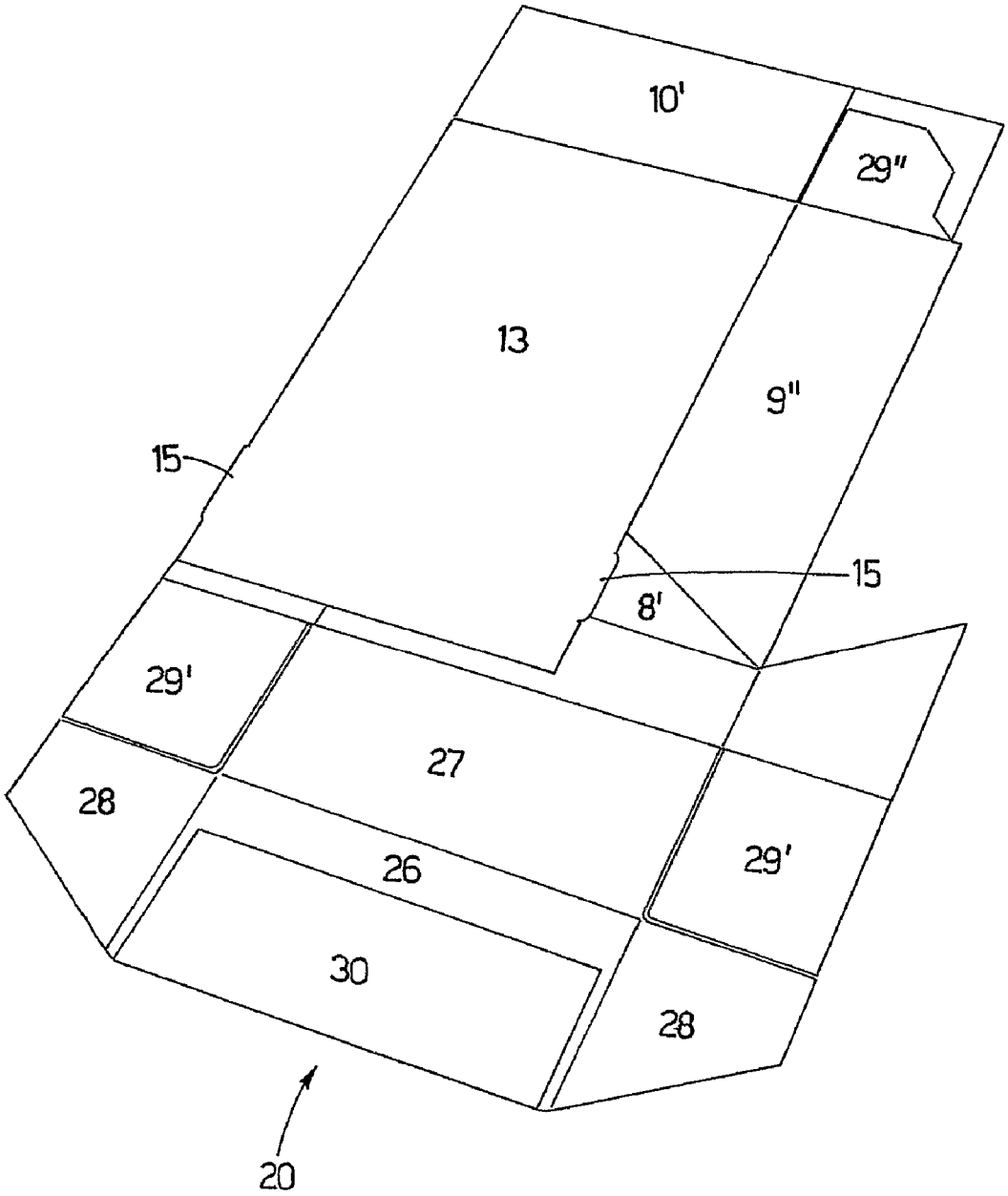
FIG. 38 shows a view in perspective of the FIG. 43 blank in a partially-folded configuration.
Figure 42:
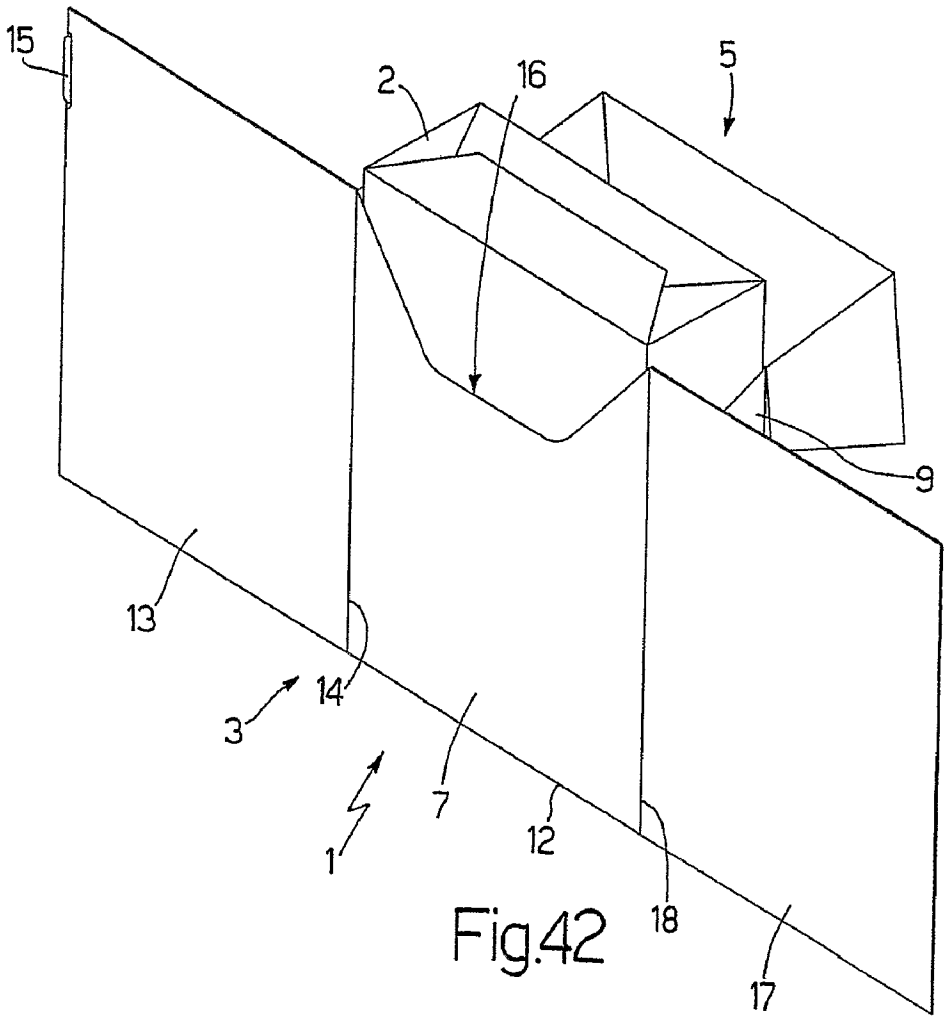
FIG. 42 shows a front view in perspective of the FIG. 39 rigid cigarette packet in an open configuration.
Figure 39:
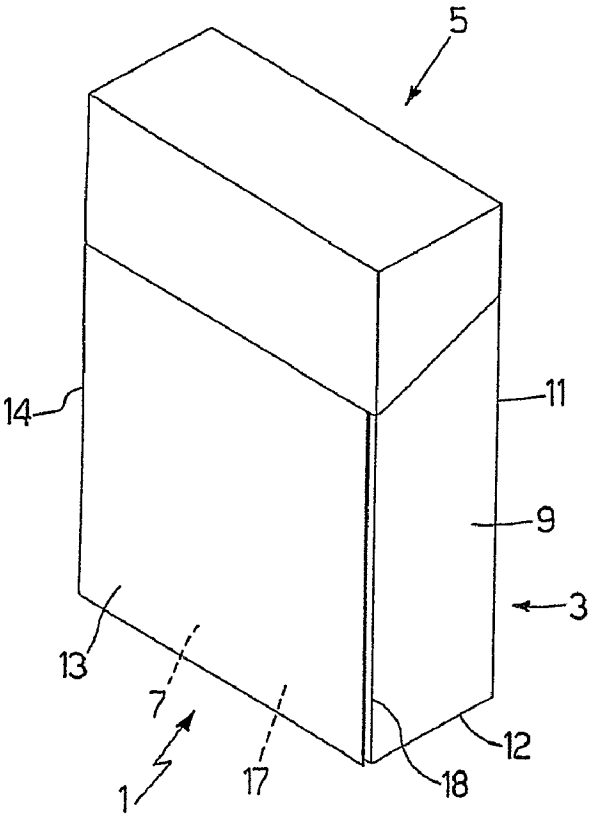
FIG. 39 shows a front view in perspective of a rigid cigarette packet in accordance with the present invention and in a closed configuration.
Figure 41:
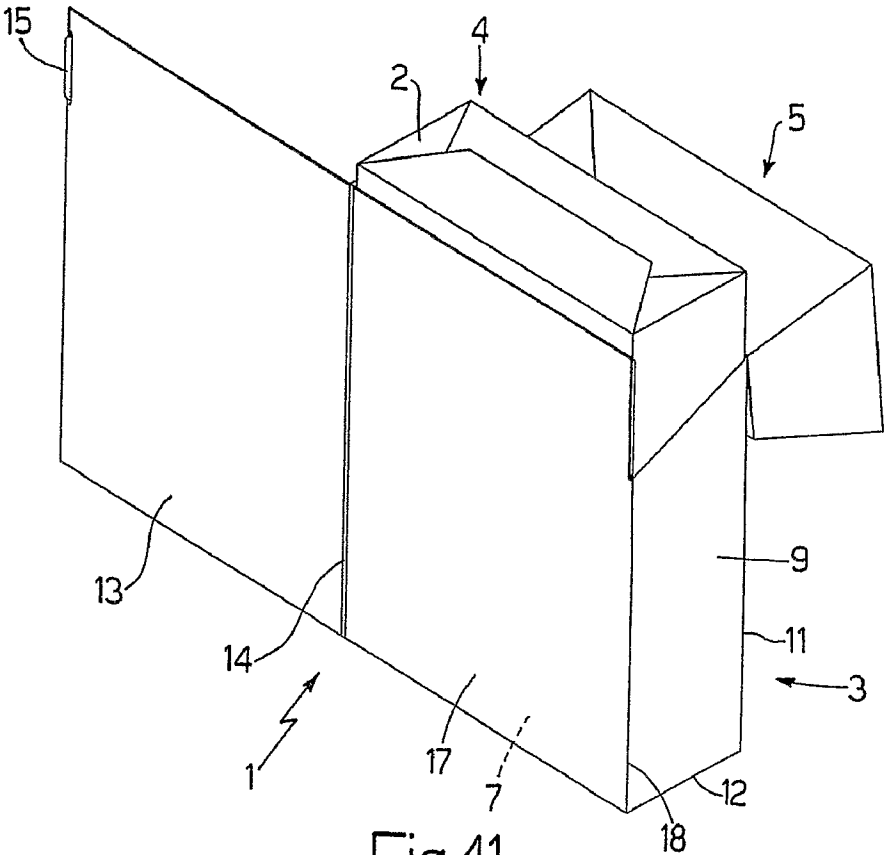
FIGS. 40 and 41 show two front views in perspective of the FIG. 39 rigid cigarette packet in a partly-open configuration.
Figure 40:
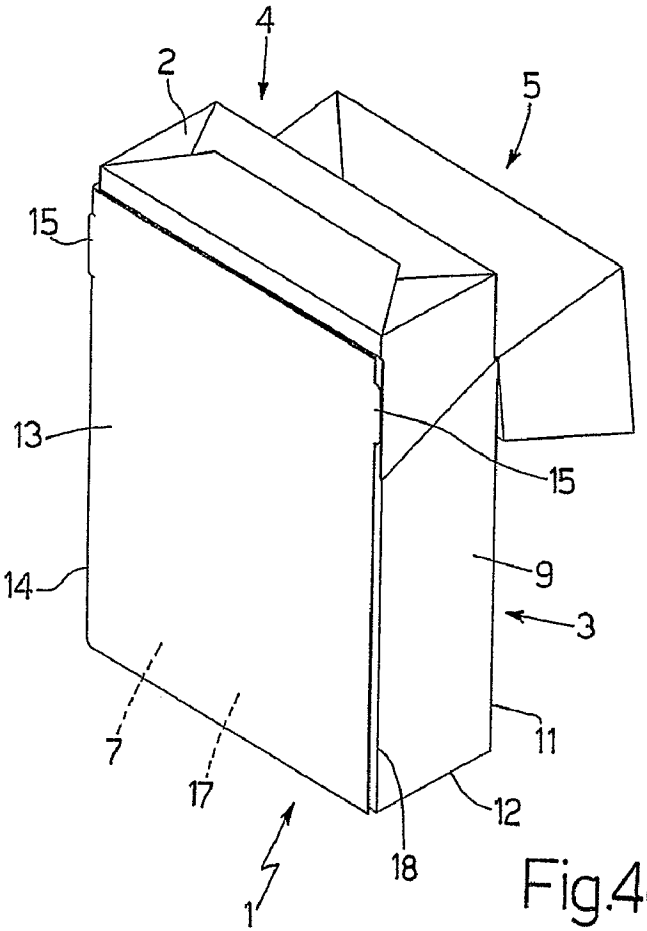

Blank 20 in FIG. 37 may be gummed and folded into the tubular configuration shown in FIG. 38. More specifically, panel 13' is folded and glued to panel 13" to define additional panel 13, and wing 9' is folded and glued to the opposite wing 9". Once formed into the tubular configuration, blank 20 in FIG. 37 may be flattened (as shown in FIG. 38) for compactness and easy storage and transport, or may be "opened" to receive an axially fed group 2 of cigarettes.

With respect to the FIG. 1-5 embodiment, as opposed to being hinged to additional panel 13, further panel 17 in the FIG. 39-42 embodiment is hinged to container 3, on the opposite side of panel 13, along a further hinge 18 coincident with a longitudinal edge 11, so that the two panels 13 and 17 define two "wings" covering front wall 7 of container 3.

With respect to the FIG. 1-5 embodiment, minor lateral walls 9 of container 3 in the FIG. 39-42 embodiment are smaller in height than rear wall 8 of container 3 to facilitate withdrawal of the cigarettes from container 3. In other words, minor lateral walls 9 in FIGS. 39-42 resemble minor lateral walls 9 in FIGS. 13-16. More specifically, the top edge of each minor lateral wall 9 substantially coincides with the equivalent bottom edge of lid 5 when lid 5 is in the closed position (FIG. 39) closing open end 4. The top edge of each minor lateral wall 9 therefore slopes, and each minor lateral wall 9 is in the form of a right-angle trapezium having the major base at rear wall 8 of container 3.

In packet 1 in FIGS. 39-42, the recess of front wall 7 of container 3 is symmetrical in shape resembling the symmetrical arrangement of panels 13 and 17 The FIG. 39-42 embodiment has no collar inside container 3, though a collar may be provided in an alternative embodiment not shown.

Figure 43:
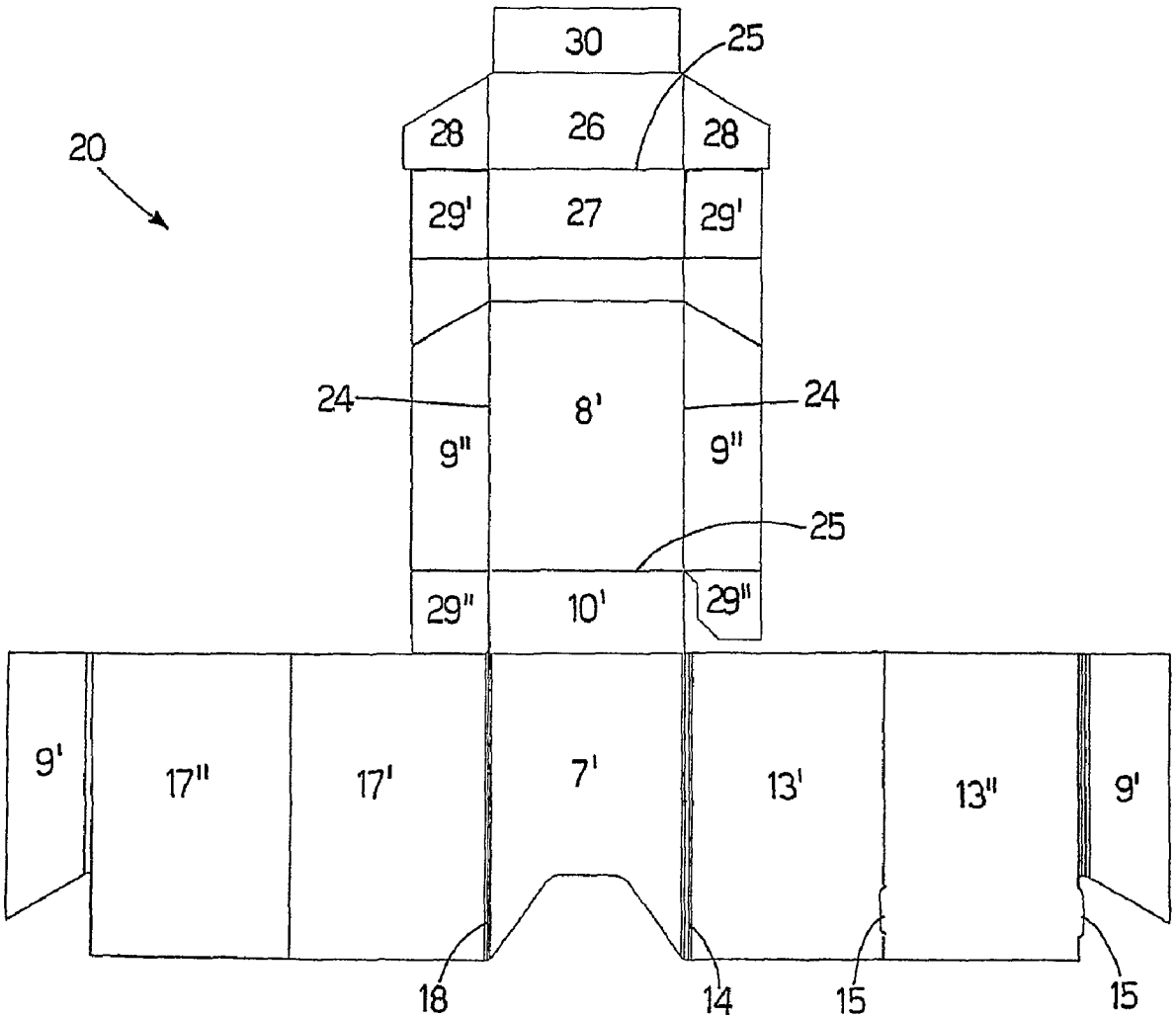
FIG. 43 shows a plan view of a blank by which to produce the rigid cigarette packet in FIG. 39.

As shown in FIG. 43, containers 3 in FIGS. 39 to 42 can be formed from a flat blank 20, the component parts of which are indicated where possible using the same reference numbers, with superscripts, as for the corresponding parts of container 3.

Blank 20 comprises two longitudinal fold lines 24; and a number of transverse fold lines 25 defining, between the two longitudinal fold lines 24, a panel 26 defining a front wall of lid 5, a panel 27 defining a top wall of lid 5, a panel 8' defining major lateral wall 8 or rear wall 8 of container 3, a panel 10' defining bottom wall 10 of container 3, and a panel 7' defining major lateral wall 7 or front wall 7 of container 3.

Panel 8' has two wings 9", which define respective parts of minor lateral walls 9 of container 3, are located on opposite sides of panel 8', and are separated from panel 8' by longitudinal fold lines 24.

Additional panel 13 is defined by two panels 13' and 13", which are superimposed and glued one to the other; panel 13' is connected to panel 7' along hinge line 14 coincident with one of longitudinal fold lines 24, and panel 13" is connected to panel 13' along a longitudinal fold line parallel to longitudinal fold lines 24.

Additional panel 17 is defined by two panels 17' and 17", which are superimposed and glued one to the other; panel 17' is connected to panel 7' along hinge line 18 coincident with one of longitudinal fold lines 24, and panel 17" is connected to panel 17' along a longitudinal fold line parallel to longitudinal fold lines 24.

Preferably, panel 26 comprises two wings 28, which define the lateral walls of lid 5, are located on opposite sides of panel 26, and are separated from panel 26 by longitudinal fold lines 24; and each wing 9" comprises two further wings 29' and 29" separated from wing 9" by transverse fold lines 25. Panel 26 also comprises a reinforcing flap 30 which is folded onto panel 26.

Minor lateral walls 9 of container 3 are partially defined by two wings 9', a first of which is connected to panel 17" along a longitudinal fold line parallel to longitudinal fold lines 24, and a second of which is connected to panel 13" along a longitudinal fold line parallel to longitudinal fold lines 24.

Figure 45:
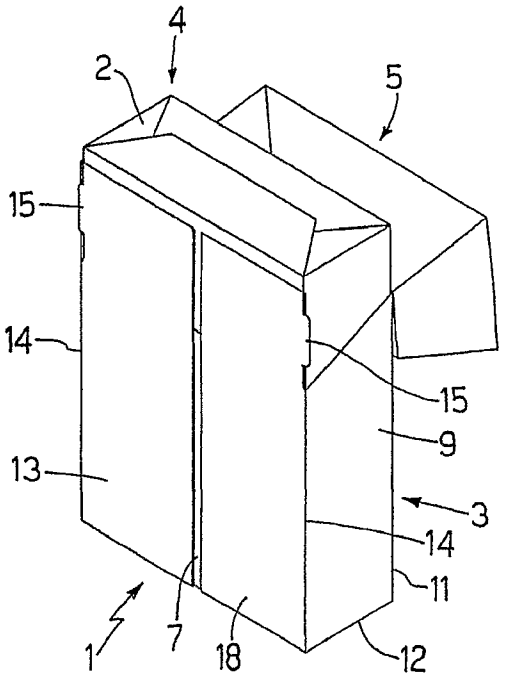
FIG. 45 shows a front view in perspective of the FIG. 44 rigid cigarette packet in a partly-open configuration.
Figure 46:
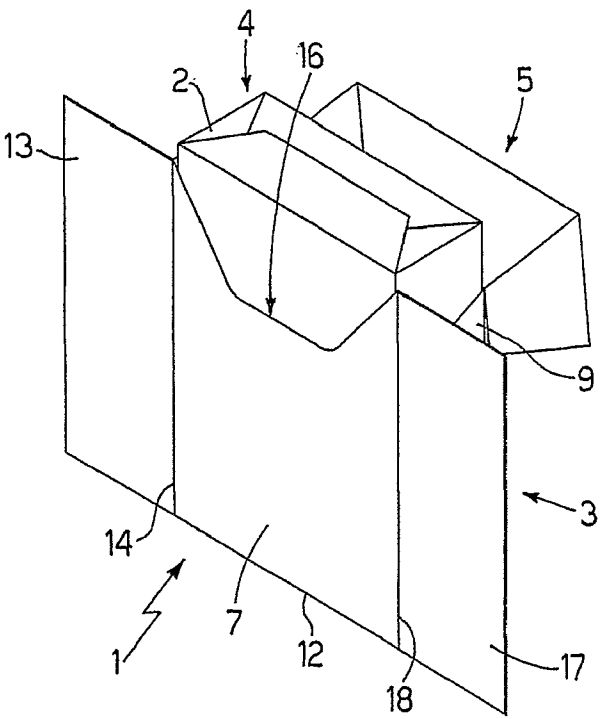
FIG. 46 shows a front view in perspective of the FIG. 44 rigid cigarette packet in an open configuration.
Figure 44:
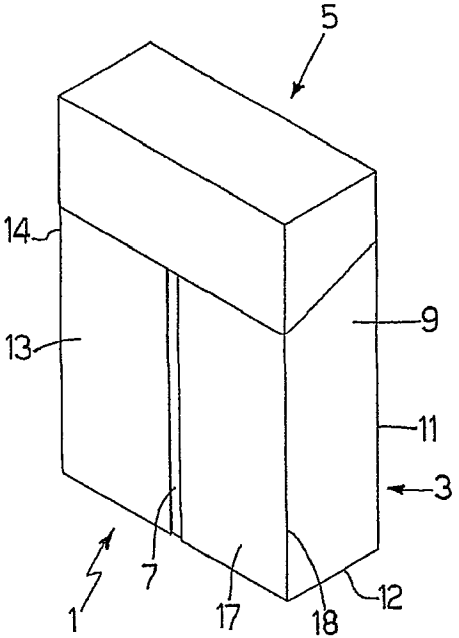
FIG. 44 shows a front view in perspective of a rigid cigarette packet in accordance with the present invention and in a closed configuration.

With respect to the FIG. 39-42 embodiment, panels 13 and 17 in the FIG. 44-46 embodiment are halved in size, and, as opposed to being superimposed one on top of the other on front wall 7 of container 3, are superimposed side by side on front wall 7 of container 3.

Figure 47:
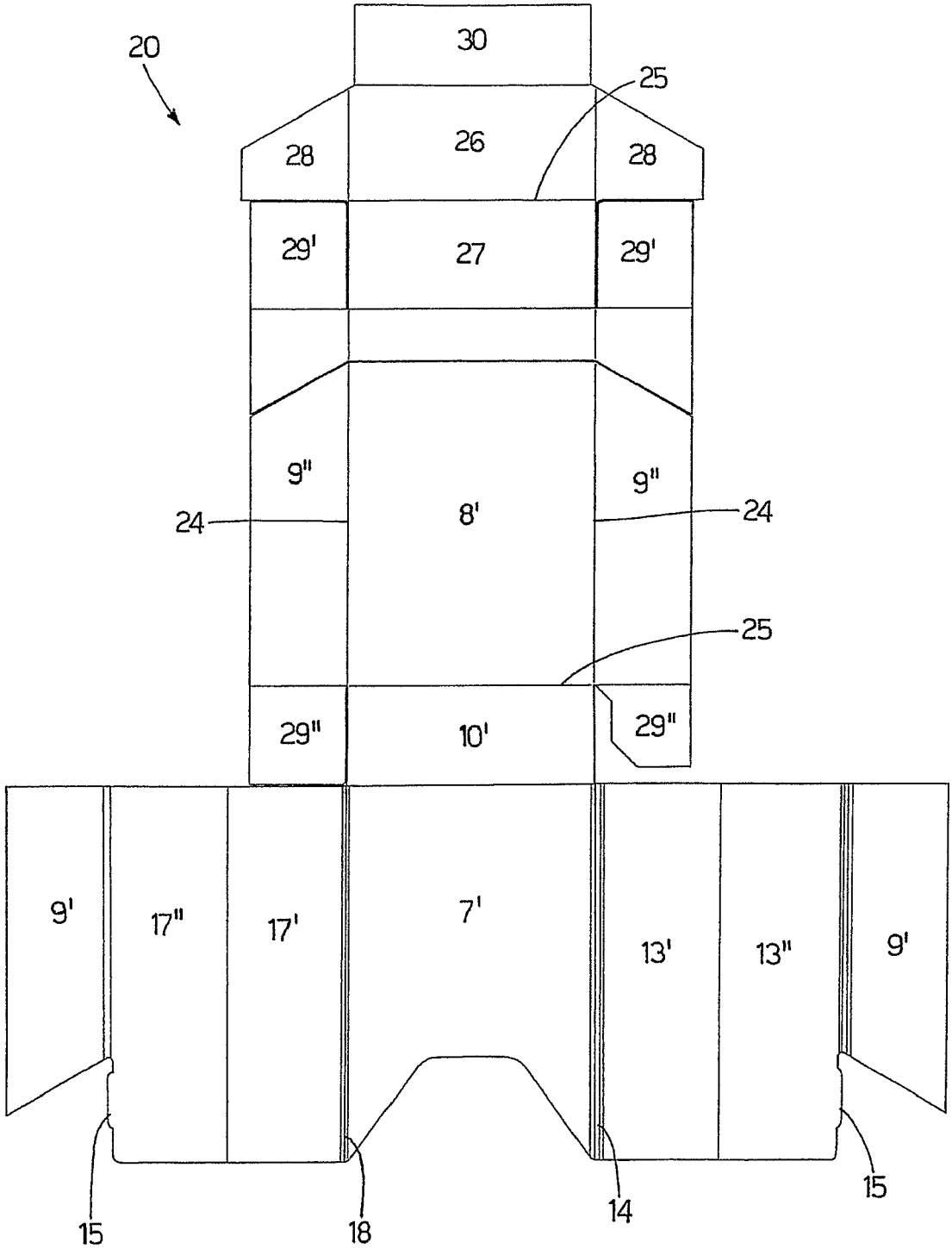
FIG. 47 shows a plan view of a blank by which to produce the rigid cigarette packet in FIG. 44.

As shown in FIG. 47, containers 3 in FIGS. 44 to 46 can be formed from a flat blank 20, the component parts of which are indicated where possible using the same reference numbers, with superscripts, as for the corresponding parts of container 3.

Blank 20 comprises two longitudinal fold lines 24; and a number of transverse fold lines 25 defining, between the two longitudinal fold lines 24, a panel 26 defining a front wall of lid 5, a panel 27 defining a top wall of lid 5, a panel 8' defining major lateral wall 8 or rear wall 8 of container 3, a panel 10' defining bottom wall 10 of container 3, and a panel 7' defining major lateral wall 7 or front wall 7 of container 3.

Panel 8' has two wings 9", which define respective parts of minor lateral walls 9 of container 3, are located on opposite sides of panel 8', and are separated from panel 8' by longitudinal fold lines 24.

Additional panel 13 is defined by two panels 13' and 13", which are superimposed and glued one to the other; panel 13' is connected to panel 7' along hinge line 14 coincident with one of longitudinal fold lines 24, and panel 13" is connected to panel 13' along a longitudinal fold line parallel to longitudinal fold lines 24.

Additional panel 17 is defined by two panels 17' and 17", which are superimposed and glued one to the other; panel 17' is connected to panel 7' along hinge line 14 coincident with one of longitudinal fold lines 24, and panel 17" is connected to panel 17' along a longitudinal fold line parallel to longitudinal fold lines 24.

Preferably, panel 26 comprises two wings 28, which define the lateral walls of lid 5, are located on opposite sides of panel 26, and are separated from panel 26 by longitudinal fold lines 24; and each wing 9" comprises two further wings 29' and 29" separated from wing 9" by transverse fold lines 25. Panel 26 also comprises a reinforcing flap 30 which is folded onto panel 26.

Minor lateral walls 9 of container 3 are partially defined by two wings 9', a first of which is connected to panel 17" along a longitudinal fold line parallel to longitudinal fold lines 24, and a second of which is connected to panel 13" along a longitudinal fold line parallel to longitudinal fold lines 24.

Packet 1 as described above has several advantages: it can be made quickly and easily on a known automatic packing machine with only a few minor adjustments; the coupon is connected physically to one of the blanks used to produce packet 1, and therefore need not be supplied separately; the cigarettes can be extracted from packet 1 by the consumer without unfolding the coupon; and, once unfolded, the coupon can be refolded quickly and easily, and can therefore be left attached to packet 1 without annoying the user.

In view of the numerous advantages of packet 1 as described above, the design of packet 1 may also be applied integrally to the manufacture of other types of rigid containers for tobacco articles, such as a cigarette carton or cigar packet.

The invention claimed is:

1. A rigid package for tobacco articles, comprising:

a cup-shaped container (3) having a substantially parallelepiped-shape, and including two major lateral walls (7, 8), two minor lateral walls (9), a bottom wall (10), and an open top end (4);

a cup-shaped lid (5) hinged along a first hinge (6) to rotate between an open position and a closed position respectively opening and closing the open end (4); and at least one additional panel (13) hinged to the container (3) along a second hinge (14) to rotate, with respect to the container (3), between an unfolded position, in which the additional panel (13) is detached from the container (3), and a folded position, in which the additional panel (13) rests on a major lateral wall (7; 8) of the container (3);

wherein when the additional panel (13) is in the folded position and the lid (5) is in the closed position, the lid (5) maintains the additional panel (13) in the folded position;

wherein the container (3) is formed from a first flat blank (19) and a second flat blank (20); the first flat blank (19) comprising two first longitudinal fold lines (21), and only one first transverse fold line (22) defining, between the two first longitudinal fold lines (21), a first panel (7') defining a second major lateral wall (7) of the container (3), and a second panel (10') defining part of the bottom wall (10) of the container (3); and the first panel (7') comprising two wings (9'), which define respective parts of the minor lateral walls (9) of the container (3), are located on opposite sides of the first panel (7'), are separated from the first panel (7') by the two first longitudinal fold lines (21), and each have a respective tab (23); and wherein a second blank (20) comprises a number of second longitudinal fold lines (24), and a number of second transverse fold lines (25) defining, between two second longitudinal fold lines (24), a third panel (26) defining a front wall of the lid (5), a fourth panel (27) defining a top wall of the lid (5), a fifth panel (8') defining a first major lateral wall (8) of the container (3), and a sixth panel (10") defining part of the bottom wall (10) of the container (3); the fifth panel (8') comprises two wings (9"), which define respective parts of the minor lateral walls (9) of the container (3), are located on opposite sides of the fifth panel (8'), and are separate from the fifth panel (8') by the second longitudinal fold lines (24); and the additional panel (13) is connected to one of the wings (9") of the fifth panel (8').

2. A package as claimed in claim 1, wherein the first hinge (6) of the lid (5) is located on a first major lateral wall (8) of the container (3), and the additional panel (13) rests on a second major lateral wall (7) when the additional panel (13) is in the folded position;

wherein four longitudinal edges (11) are defined between the major lateral walls (7, 8) and the minor lateral walls (9) of the container (3); and the first hinge (6) of the lid (5) is perpendicular to the longitudinal edges (11); and wherein the second hinge (14) of the additional panel (13) is parallel to the longitudinal edges (11) and coincide with one of the longitudinal edges (11) extending along the second major lateral wall (7).

3. A package as claimed in claim 2, wherein a collar (31) is provided, and is folded into a U and glued to the inside of the container (3) to project partly outwards of the open top end (4) and engage a corresponding inner surface of the lid (5) when the lid (5) is in the closed position.

4. A package as claimed in claim 2, wherein a movable insert (43) is connected to the second major lateral wall (7) of the container (3), is parallel to and rests on the second major lateral wall (7) when the additional panel (13) is positioned against the second major lateral wall (7), and is erected perpendicular to the second major lateral wall (7) when the additional panel (13) is detached from the second major lateral wall (7); and a marginal portion of the movable insert (43) is fixed to an inner surface of the additional panel (13), so that the movable insert (43) is moved automatically as the additional panel (13) rotates about the second hinge (14).

5. A package as claimed in of claim 2, and comprising a further panel (17) hinged to the second major lateral wall (7) of the container (3) along a third hinge (18) parallel to and opposite the second hinge (14), the two panels (13, 17) define two "wings" covering the second major lateral wall (7) of the container (3).

6. A package as claimed in claim 5, wherein the two panels (13, 17) are each the same size as the second major lateral wall (7) of the container (3), and are superimposed one on top of the other on the second major lateral wall (7).

7. A package as claimed in claim 5, wherein the two panels (13, 17) are each half the size of the second major lateral wall (7) of the container (3), and are superimposed side by side on the second major lateral wall (7).

8. A package as claimed in claim 1, wherein the additional panel (13) comprises two projections (15), which project laterally and engage respective inner surfaces of the lid (5) when the lid (5) is in the closed position.

9. A package as claimed in claim 1, wherein the additional panel (13) has a central through hole (37), through which a corresponding underlying portion of the second major lateral wall (7) of the container (3) is visible when the additional panel (13) is positioned contacting the second major lateral wall (7).

10. A package as claimed in claim 1, wherein a seat (40) for a small object (41) is formed on an inner surface of the additional panel (13).

11. A package as claimed in claim 10, wherein, to allow for the thickness of the object (41), the additional panel (13) comprises two tabs (42) for keeping the additional panel (13) raised with respect to the second major lateral wall (7) of the container (3) when the additional panel (13) is positioned against the second major lateral wall (7).

12. A package as claimed in claim 1, and comprising a further panel (17) hinged to the additional panel (13) along a third hinge (18) parallel to and opposite the second hinge (14).

13. A package as claimed in claim 1, wherein top portions of a second major lateral wall (7) and of the minor lateral walls (9) of the container (3) which come into contact with the lid (5) when the lid (5) is in said closed position are depressed with respect to the rest of the second major lateral wall (7) and of the minor lateral walls (9) of the container (3).

14. A package as claimed in claim 1, wherein a releasable fastening system (33) is provided between the additional panel (13) and the respective major lateral wall (7; 8) of the container (3), to keep the additional panel (13) in contact with the respective major lateral wall (7; 8) of the container (3) with a certain amount of force when the additional panel (13) is in said folded position.

15. A package as claimed in claim 14, wherein the releasable fastening system (33) comprises a slit (36) formed in the major lateral wall (7; 8) of the container (3) and for receiving a bottom edge of the additional panel (13).

16. A package as claimed in claim 15, wherein the bottom edge of the additional panel (13) inserted inside the slit (36) is rounded.

17. A package as claimed in claim 14, wherein the releasable fastening system (33) comprises a tongue (35) projecting laterally from the additional panel (13); and a slit (36) for receiving the tongue (35), and which is formed through a major lateral wall (7; 8) of the container (3).

18. A rigid package for tobacco articles, comprising:

a cup-shaped container (3) having a substantially parallelepiped-shape, and including two major lateral walls (7, 8), two minor lateral walls (9), a bottom wall (10), and an open top end (4);

a cup-shaped lid (5) hinged along a first hinge (6) to rotate between an open position and a closed position respectively opening and closing the open end (4); and at least one additional panel (13) hinged to the container (3) along a second hinge (14) to rotate, with respect to the container (3), between an unfolded position, in which the additional panel (13) is detached from the container (3), and a folded position, in which the additional panel (13) rests on a major lateral wall (7; 8) of the container (3) and is maintained contacting the major lateral wall (7; 8) of the container (3) by the lid (5) in the closed position;

wherein the container (3) is formed from a first blank (19) and a second blank (20);

the first blank (19) comprises two first longitudinal fold lines (21), and only one first transverse fold line (22) defining, between the two first longitudinal fold lines (21), a first panel (7') defining a second major lateral wall (7) of the container (3), and a second panel (10') defining part of the bottom wall (10) of the container (3); and the first panel (7') comprises two wings (9'), which define respective parts of the minor lateral walls (9) of the container (3), are located on opposite sides of the first panel (7'), are separated from the first panel (7') by the two first longitudinal fold lines (21), and each have a respective tab (23); and wherein the second blank (20) comprises a number of second longitudinal fold lines (24), and a number of second transverse fold lines (25) defining, between two second longitudinal fold lines (24), a third panel (26) defining a front wall of the lid (5), a fourth panel (27) defining a top wall of the lid (5), and the additional panel (13); the second blank (20) also comprises a fifth panel (8') defining a first major lateral wall (8) of the container (3), and a sixth panel (10") defining part of the bottom wall (10) of the container (3); the fifth panel (8') comprises two wings (9"), which define respective parts of the minor lateral walls (9) of the container (3), are located on opposite sides of the fifth panel (8'), and are separated from the fifth panel (8') by second longitudinal fold lines (24); and the additional panel (13) is connected to one of the wings (9") of the fifth panel (8').

19. A package as claimed in claim 18, wherein the third panel (26) comprises two wings (28), which define the lateral walls of the lid (5), are located on opposite sides of the third panel (26), and are separated from the third panel (26) by second longitudinal fold lines (24); and the fourth panel (27) comprises two wings (29) located on opposite sides of the fourth panel (27) and separated from the fourth panel (27) by second longitudinal fold lines (24).

20. A package as claimed in claim 18, wherein the additional panel (13) has a central through hole (37), through which a corresponding underlying portion of a major lateral wall (7) of the container (3) is visible when the additional panel (13) is positioned contacting the major lateral wall (7).

21. A package as claimed in claim 18, wherein the first hinge (6) of the lid (5) is located on the additional panel (13), which rests on a first major lateral wall (8) when the additional panel (13) is in the folded position.

22. A package as claimed in claim 21, wherein four longitudinal edges (11) are defined between the major lateral walls (7, 8) and the minor lateral walls (9) of the container (3); the first hinge (6) of the lid (5) is perpendicular to the longitudinal edges (11) when the additional panel (13) is in the folded position; and the second hinge (14) of the additional panel (13) is parallel to the longitudinal edges (11) and coincident with one of the longitudinal edges (11) extending along the first major lateral wall (8).

23. A package as claimed in claim 21, wherein the first hinge (6) of the lid (5) is located at a top perimeter line of the first major lateral wall (8) when the additional panel (13) is in the folded position.

24. A package as claimed in claim 23, wherein a second major lateral wall (7) of the container (3) comprises two projections (15), which project laterally and engage respective inner surfaces of the lid (5) when the lid (5) is in the closed position.

25. A package as claimed in claim 23, wherein a top portion of the first major lateral wall (8) of the container (3) comprises a recess (16).

26. A package as claimed in claim 23, wherein a top portion of a second major lateral wall (7) of the container (3) comprises a recess (16).

27. A package as claimed in claim 18, and comprising a further panel (17) hinged to the additional panel (13) along a third hinge (18) parallel to and opposite the second hinge (14).

28. A rigid package for tobacco articles, comprising:

a cup-shaped container (3) having a substantially parallelepiped-shape, and including two major lateral walls (7, 8), two minor lateral walls (9), a bottom wall (10), and an open top end (4);

a cup-shaped lid (5) hinged along a first hinge (6) to rotate between an open position and a closed position respectively opening and closing the open end (4); and at least one additional panel (13) hinged to the container (3) along a second hinge (14) to rotate, with respect to the container (3), between an unfolded position, in which the additional panel (13) is detached from the container (3), and a folded position, in which the additional panel (13) rests on a major lateral wall (7; 8) of the container (3), the additional panel (13) being maintained in the folded position by the lid (5) when the lid (5) is in the closed position;

wherein the container (3) is formed from only one flat blank (20) comprising a number of longitudinal fold lines (24), and a number of transverse fold lines (25) defining, between two longitudinal fold lines (24), a first panel (26) defining a front wall of the lid (5), a second panel (27) defining a top wall of the lid (5), a third panel (8') defining a first major lateral wall (8) of the container (3), a fourth panel (10') defining part of the bottom wall (10) of the container (3), and a sixth panel (7') defining a second major lateral wall (7); the third panel (8') comprises two first wings (9"), which define respective parts of the minor lateral walls (9) of the container (3), are located on opposite sides of the third panel (8'), and are separated from the third panel (8') by the longitudinal fold lines (24); and wherein the additional panel (13) is connected to the sixth panel (7');

wherein the additional panel (13) is defined by a seventh panel (13') and by an eighth panel (13"), which are superimposed and glued to one another; the seventh panel (13') is connected to the sixth panel (7') along the second hinge line (14) coincident with one of the longitudinal fold lines (24), and the eighth panel (13") is connected to the seventh panel (13') along a fold line parallel to the longitudinal fold lines (24);

wherein minor lateral walls (9) of the container (3) are partially defined by a first third wing (9) connected to the seventh panel (7') along a longitudinal fold line (24), and a second third wing (9) connected to the eighth panel (13") along a fold line parallel to the longitudinal fold lines (24).

29. A rigid package for tobacco articles, comprising:

a cup-shaped container (3) having a substantially parallelepiped-shape, and including two major lateral walls (7, 8), two minor lateral walls (9), a bottom wall (10), and an open top end (4);

a cup-shaped lid (5) hinged along a first hinge (6) to rotate between an open position and a closed position respectively opening and closing the open end (4); and at least one additional panel (13) hinged to the container (3) along a second hinge (14) to rotate, with respect to the container (3), between an unfolded position, in which the additional panel (13) is detached from the container (3), and a folded position, in which the additional panel (13) rests on a major lateral wall (7; 8) of the container (3) and is maintained in the folded position by the lid (5) when the lid (5) is in the closed position;

wherein the container (3) is formed from a first flat blank (19) and a second flat blank (20); the first blank (19) comprises two first longitudinal fold lines (21), and a first transverse fold line (22) defining, between the two first longitudinal fold lines (21), a first panel (7') defining a second major lateral wall (7) of the container (3), and a second panel (10') defining part of the bottom wall (10) of the container (3); and the first panel (7') comprises two wings (9'), which define respective parts of the minor lateral walls (9) of the container (3), are located on opposite sides of the first panel (7'), and are separated from the first panel (7') by the two first longitudinal fold lines (21);

wherein the second blank (20) comprises a number of second longitudinal fold lines (24), and a number of second transverse fold lines (25) defining, between two second longitudinal fold lines (24), a third panel (26) defining a front wall of the lid (5), a fourth panel (27) defining a top wall of the lid (5), a fifth panel (8') defining a first major lateral wall (8) of the container (3), and a sixth panel (10") defining part of the bottom wall (10) of the container (3); the fifth panel (8') comprises two wings (9"), which define respective parts of the minor lateral walls (9) of the container (3), are located on opposite sides of the fifth panel (8'), and are separated from the fifth panel (8') by the second longitudinal fold lines (24); and wherein the additional panel (13) is defined by a seventh panel (13') and by an eighth panel (13"), which are superimposed and glued one to the other; the seventh panel (13') is connected to the sixth panel (10") along a transverse fold line (25), and the eighth panel (13") is connected to the seventh panel (13') along a fold line parallel to the longitudinal fold lines (24).

* * * * *